United States Patent [19]

Friedman et al.

[11] Patent Number: 4,592,461

[45] Date of Patent: Jun. 3, 1986

[54] VENDING MACHINE WITH COIN SORTER AND TOTALIZER

[75] Inventors: Evelyn Friedman, P.O. Box 149, Whitehall, N.Y. 12887; William R. Carswell, Whitehall, N.Y.

[73] Assignee: Evelyn Friedman, Whitehall, N.Y.

[21] Appl. No.: 489,848

[22] Filed: Apr. 29, 1983

[51] Int. Cl.[4] ..... G07F 3/04; G07F 5/08

[52] U.S. Cl. ..... 194/227; 133/3 D

[58] Field of Search ..... 194/1 L, DIG. 3, 94, 194/1 K; 133/3 D, 3 R

[56] References Cited

U.S. PATENT DOCUMENTS

| | | | |
|---|---|---|---|
| 2,339,823 | 1/1944 | Vogel | 194/103 X |
| 3,126,082 | 3/1964 | Maxwell | 194/94 |
| 4,227,604 | 10/1980 | Chalabian | 133/3 D X |

*Primary Examiner*—F. J. Bartuska

*Attorney, Agent, or Firm*—Edgar N. Jay

[57] ABSTRACT

A vending machine for newspapers and the like having a coin operated mechanism with:

(a) a coin sorter;

(b) a coin chute assembly having a plurality of vertical chutes through which coins of different denominations, from the coin sorter, fall;

(c) a trip wire, one end of which extends through the coin chutes and can move downwardly in the chutes with downward movement of coins;

(d) a totalizer, connected to the other end of the trip wire, for counting the value of coins which fall through the coin chutes; and (e) a vending controller connected to the totalizer.

The coin operated mechanism has an improved totalizer with:

a lever, connected at one end to the other end of the trip wire and rotatably connected between its ends to the mechanism;

a dog, rotatably connected to the lever between the other end of the lever and the rotatable connection of the lever to the mechanism; the dog being adapted to revolve with the other end of the lever about the rotatable connection of the lever to the mechanism; one end of the dog extending toward the rotatable connection of the lever to the mechanism and being adapted to revolve about the rotatable connection of the dog to the lever, so as to move vertically relative to the lever; and a ratchet wheel, parallel to the lever and the dog and located on the same side of the lever as the dog; the ratchet wheel being adapted to rotate about the rotatable connection of the lever to the mechanism; the one end of the dog being adapted to urge a gear tooth on the circumference of the ratchet wheel to revolve about the rotatable connection of the lever to the mechanism with revolution of the dog about the rotatable connection of the lever to the mechanism when the one end of the lever moves downwardly with the one end of the trip wire.

19 Claims, 22 Drawing Figures

13
204
72
180
174
188
180A
180B
180A
195A
197A
199
194
196
13
73
83
103A
57A
58A
140
155
148
68
69
63
56
57
58
170
266A
266
265
265A
70
64
59
60
260
264
52
9
9
258
46

VENDING MACHINE WITH COIN SORTER AND TOTALIZER

BACKGROUND OF THE INVENTION

This invention relates to a vending machine for newspapers, periodicals and the like. This invention more particularly relates to a coin operated mechanism for controlling the operation of the vending machine.

Coin operated mechanisms for controlling the operations of vending machines are well known. See, for example, U.S. Pat. Nos. 4,037,701, 4,000,799, 3,946,848, 3,921,779, 3,882,984, 3,149,709 and 2,991,867. Typically, coin operated mechanisms have included: (1) a sorter for separating the coins, deposited by a customer, into different denominations (e.g., into dimes, nickels and quarters); (2) a totalizer for counting the value of the deposited coins; and (3) a vending controller for (a) sensing when the total value of the deposited coins, counted by the totalizer, equals the price of the item being vended and (b) then enabling the customer to remove the purchased item from the vending machine (e.g., by unlocking an access door on the vending machine).

SUMMARY OF THE INVENTION

In accordance with one embodiment of this invention, a vending machine is provided having a coin operated mechanism with:

(a) a coin sorter for separating coins, deposited in the machine, into different denominations;

(b) a coin chute assembly comprisinq at least one generally vertical chute through which coins of a denomination, from the coin sorter, fall;

(c) a trip wire, one end of which extends through the chute in the coin chute assembly and can move downwardly in the chute with downward movement of a coin through the chute along a measured distance in the chute;

(d) a totalizer, connected to the other end of the trip wire, for counting the value of coins which fall through the chute in the coin chute assembly; and (e) a vending controller connected to the totalizer; and an improvement in the totalizer that comprises:

a lever which is connected at one end to the other end of the trip wire and is rotatably connected between its ends to the mechanism; said one end of the lever moving downward about its rotatable connection to the mechanism with downward movement of said one end of the trip wire;

a dog, rotatably connected to the lever between an adjacent end of the lever and the rotatable connection of the lever to the mechanism; the dog being adapted to revolve with the adjacent end of the lever about the rotatable connection of the lever to the mechanism; one end of the dog extending toward the rotatable connection of the lever to the mechanism and being adapted to revolve about the rotatable connection of the dog to the lever, so as to move vertically relative to the lever; and a ratchet wheel, parallel to the lever and the dog and located on the same side of the lever as the dog; the ratchet wheel being adapted to rotate about the rotatable connection of the lever to the mechanism; said one end of the dog being adapted to urge a gear tooth on the circumference of the ratchet wheel to revolve about the rotatable connection of the lever to the mechanism with revolution of the dog about the rotatable connection of the lever to the mechanism when said one end of the lever moves downwardly with said one end of the trip wire.

In accordance with another embodiment of this invention, an improved coin sorter is provided for a vending machine, comprising a downwardly extending trough formed by at least four upstanding side walls and a base; one side wall being rotatably connected to the two adjacent side walls on its lateral sides, so that the bottom of the one side wall can be rotated away from a side wall on the opposite side of the trough to open up the bottom of the trough.

BRIEF DESCRIPTION OF THE DRAWINGS

In FIG. 1, a door on the front of the vending machine is held closed, preventing access to the contents of the vending machine until the coin operated mechanism is actuated.

In FIG. 3, a latch within the vending machine holds the door of the vending machine closed.

In FIG. 8, the latch within the vending machine has been moved upwardly by the coin operated mechanism so the door of the vending machine can be opened.

DETAILED DESCRIPTION OF THE INVENTION

Figure 1:
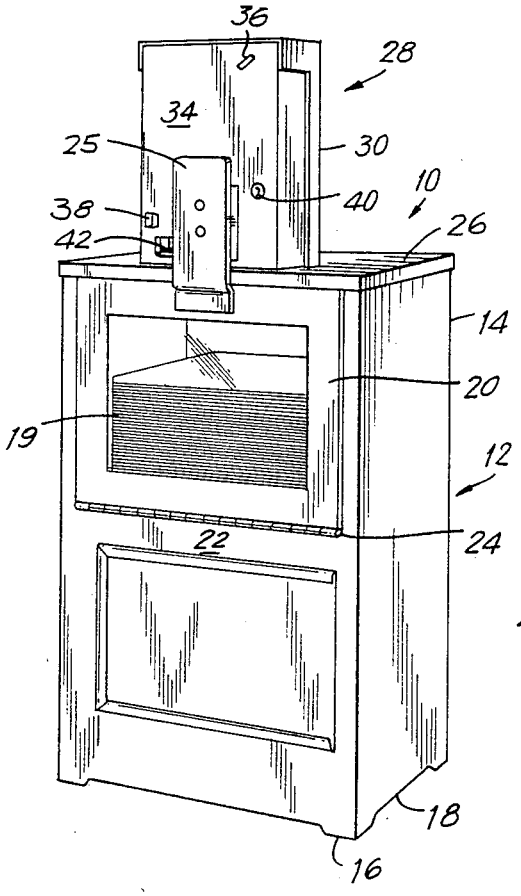
FIG. 1 is a perspective view of a vending machine for newspapers, periodicals and the like in accordance with this invention. The vending machine is provided with a coin operated mechanism of this invention.
Figure 2:
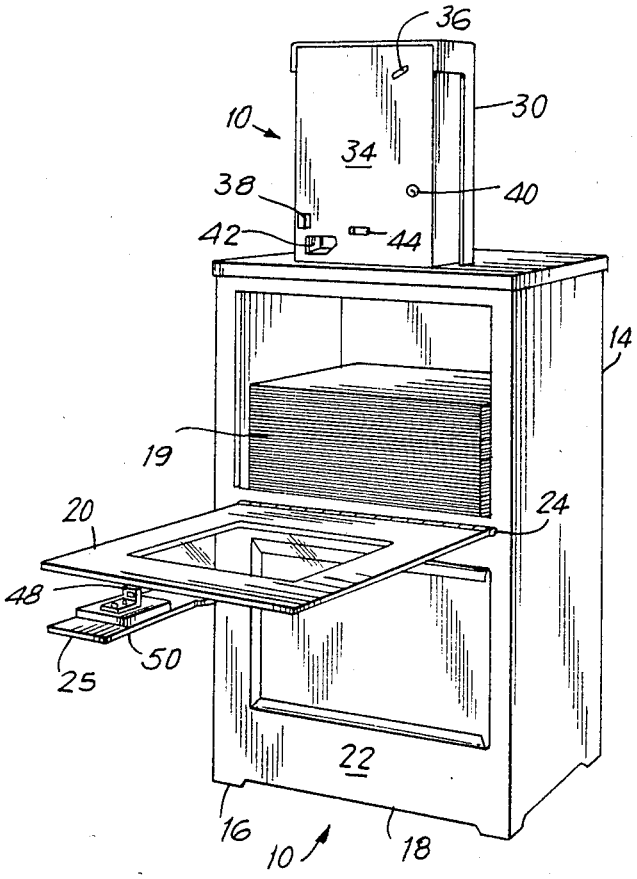
FIG. 2 is a perspective view of the vending machine, shown in FIG. 1, with the door of the vending machine open.

Shown in FIGS. 1 to 22 is a vending machine, generally 10, of this invention. As best seen in FIGS. 1 and 2, the vending machine 10 has a conventional lower housing, generally 12. The housing 12 comprises a lower enclosure 14 formed by substantially rectangular metal walls. The enclosure 14 is supported by a plurality of legs 16 attached to its base 18. The enclosure 14 is adapted to hold a stack 19 of newspapers, periodicals or the like within it. A conventional rectangular door 20 is attached to the front wall 22 of the enclosure 14 by a plurality of hinges 24 along the lower edge of the door 20. An upwardly extending member or extension 25 is provided on the upper edge of the door 20 which is adapted to serve as a handle for the door. The door 20 can be opened to allow the stack 19 of newspapers or the like to be placed in the enclosure 14 and to allow a purchaser of a newspaper or the like to remove subsequently one of the newspapers from the enclosure 14. Preferably, spring means (not shown) are connected to the door 20 and the enclosure 14 to close the door 20 when it is not being held open while newspapers or the like are being placed in, or removed from, the enclosure 14.

Attached to the top wall 26 of the lower enclosure 14 is a conventional upper housing, generally 28, that is also best seen in FIGS. 1 and 2. The upper housing 28 comprises an upper enclosure 30 formed by substantially rectangular metal walls. The upper enclosure 30 is adapted to have a coin operated mechanism of this invention, generally 32, mounted within it. The coin operated mechanism 32 is best seen in FIGS. 3 to 22.

As shown in FIGS. 1 and 2, the front wall 34 of the upper enclosure 30 is provided with the following conventional elements: a coin insert slot 36, a coin return actuator 38, a price selector lock 40 and a coin return opening 42. The front wall 34 also has a locking opening 44 in it, located to the rear of the extension 25 on the door 20 when the door is closed as in FIG. 1. Within the upper enclosure 30 and adjacent to the locking opening 44 is a latch 46, shown in FIGS. 3 and 4, that is adapted to move vertically past the locking opening 44.

Figure 3:
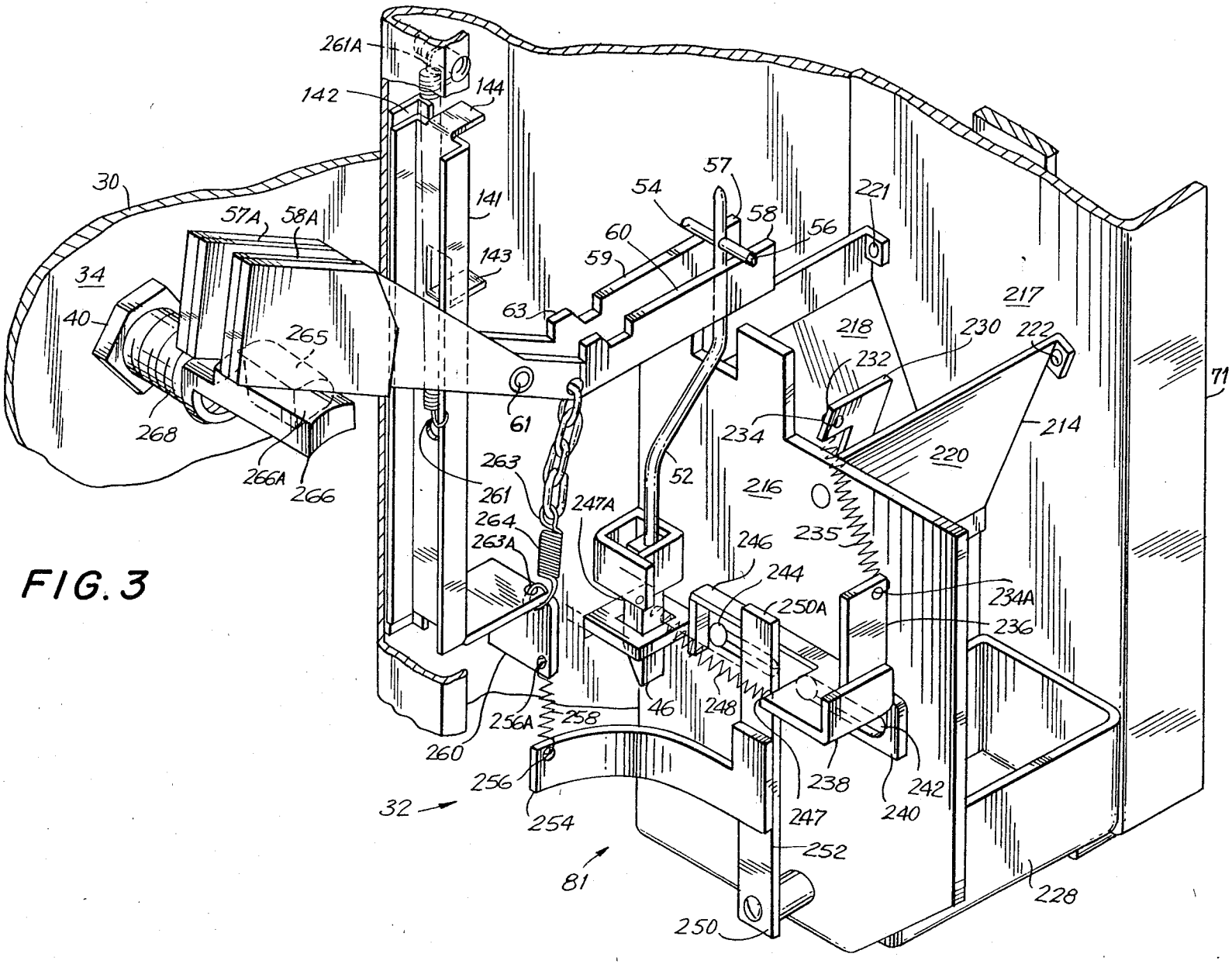
FIG. 3 is a perspective view of portions of the coin operated mechanism within the vending machine.

As shown in FIG. 2, a tongue 48 is provided on the rear of the extension 25 on the door 20. The tongue 48 is at a right angle to the extension 25 and is adapted to move horizontally and rearwardly through the locking opening 44, into the upper enclosure 30, as the door 20 is moved rearwardly towards the front wall 22 of the lower enclosure 14, about the hinges 24, so as to close the lower enclosure 14 as shown in FIG. 1. The tongue 48 has an opening 50, extending through it, parallel to the extension 25. As shown in FIG. 3, the latch 46 can move downwardly through the opening 50 in tongue 48 when: (1) the door 20 is adjacent to the front wall 22 of the lower enclosure 14, (2) the extension 25 is adjacent to the front wall 34 of the upper enclosure 30, and (3) the tongue 48 extends inwardly of the upper enclosure 30 through the locking opening 44, so as to hold the door 20 closed against the front wall 22 of the lower enclosure 14. To facilitate the insertion of the latch 46 into the opening 50 of the tongue 48, the front of the latch is beveled downwardly and rearwardly.

Figure 4:
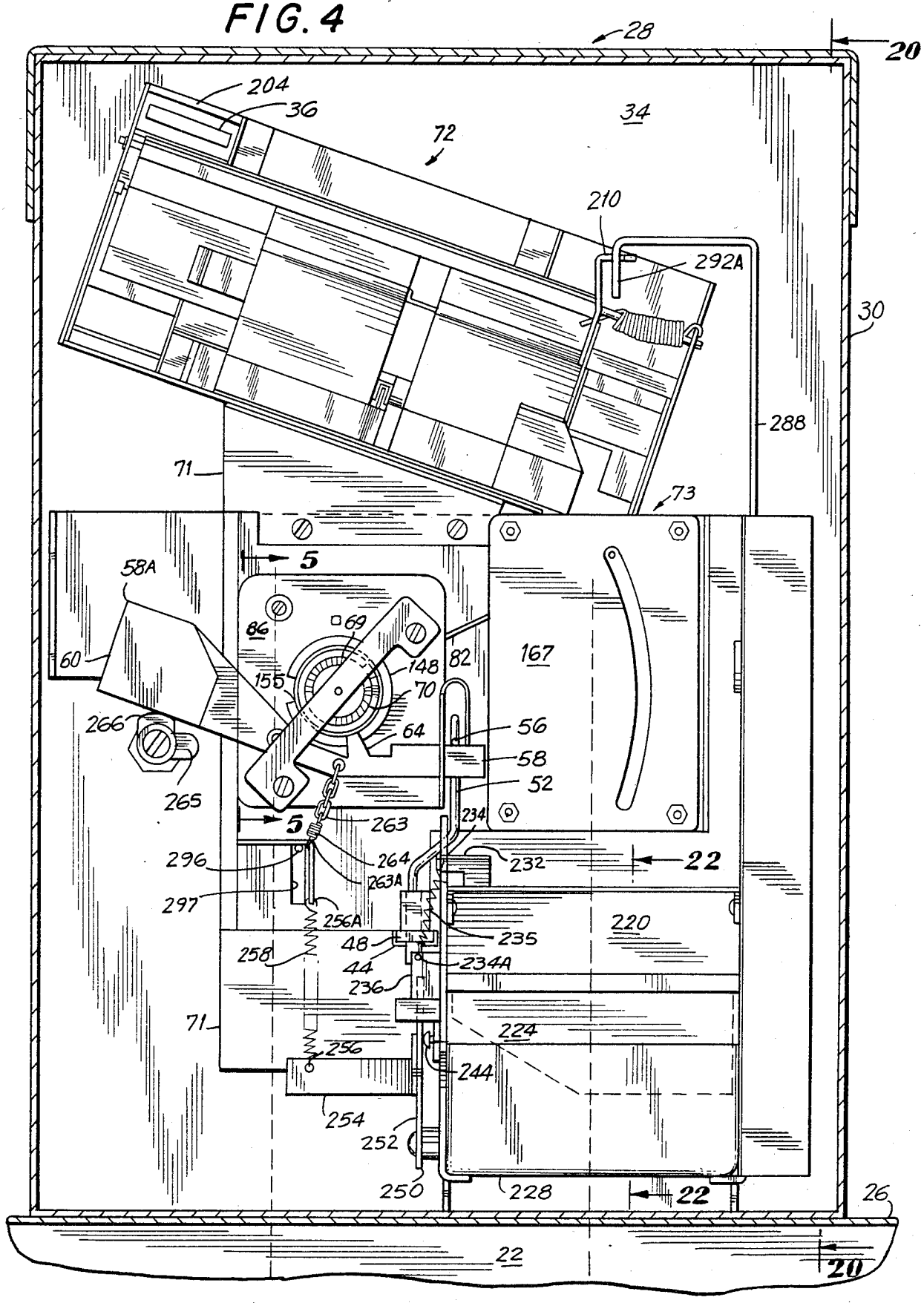
FIG. 4 is a rear view of the coin operated mechanism within the vending machine as shown in FIG. 3.
Figure 8:
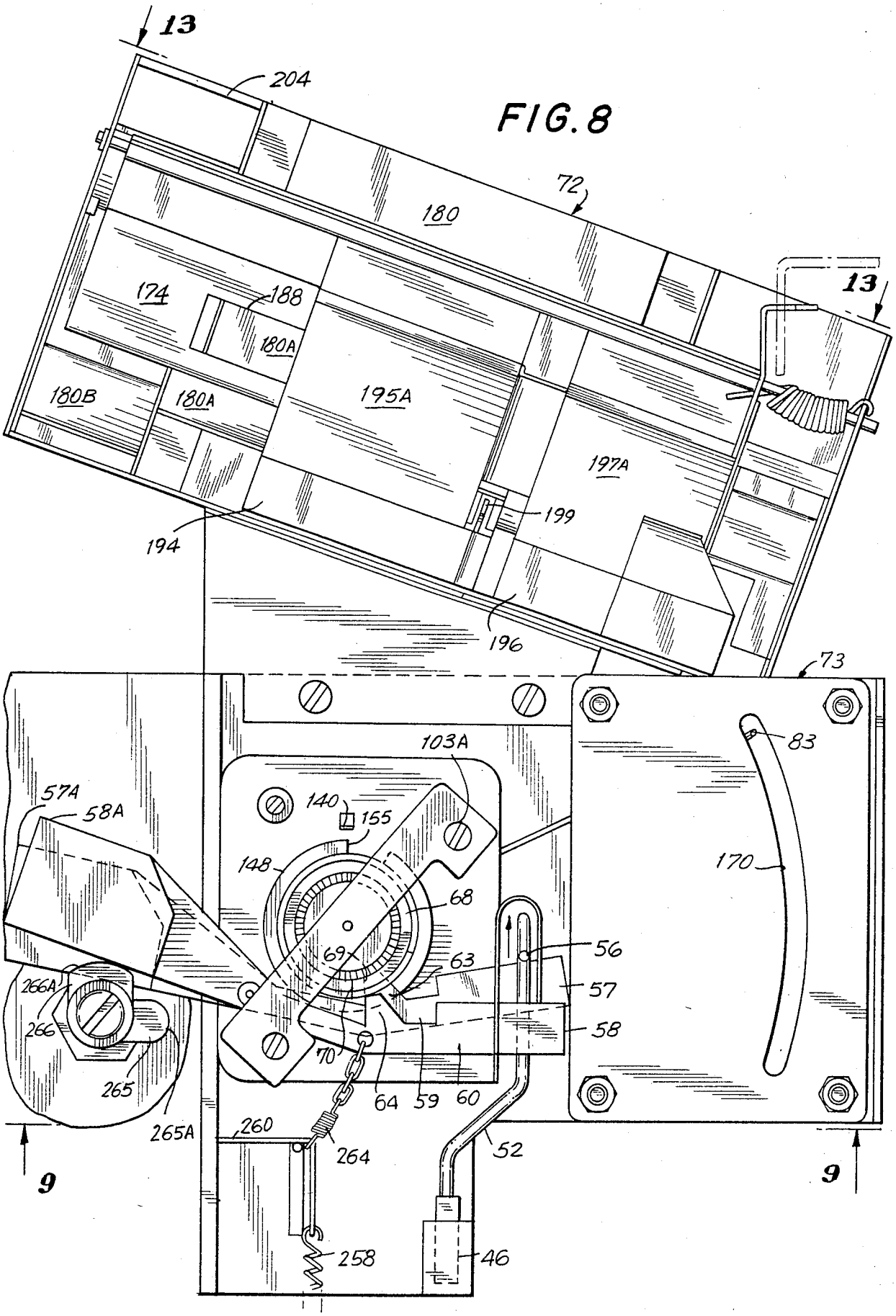
FIG. 8 is a rear view of the upper portions of the coin operated mechanism, similar to FIG. 4.

As shown in FIGS. 3, 4 and 8, the top of the latch 46 is attached to the bottom of an upwardly extending, T-shaped bar 52. The top of the T-shaped bar 52 has a pair of arms 54 and 56 extending in opposite directions, one arm 54 extending frontally and the other arm 56 extending rearwardly. Each arm 54 and 56 rests atop one lateral end 57 and 58, respectively, of a pair of substantially parallel, laterally extending, front and rear, feeler levers 59 and 60, respectively. The feeler levers 59 and 60 are rotatably mounted on a rearwardly extending, first pin 61 mounted as described below on the coin operated mechanism 32. The other lateral end 57A and 58A of each feeler lever 59 and 60, respectively, is counterweighted. As a result, the one end 57 and 58 of each feeler lever 59 and 60 and each arm 54 and 56 of the T-shaped bar 52, resting thereon, are biased upwardly about the first pin 61.

As also shown in FIGS. 3, 4 and 8, an upwardly extending finger 63 and 64 is provided on top of each feeler lever 59 and 60, respectively. Each finger 63 and 64 is located between the one end 57 and 58 of each feeler lever 59 and 60 and the first pin 61. The top of each finger 63 and 64 is urged upwardly by the counterweighted end 57A and 58A of its feeler lever 59 and 60 towards the center, and against the bottom of the circumference, of a different one of a pair of laterally extending, parallel, front and rear, circular cams 66 and 68, respectively, located above the feeler levers 59 and 60, respectively. Each cam 66 and 68 has a notch 69 and 70, respectively, in its circumference. As will be described hereinafter, each cam 66 and 68 is adapted to be rotated about a common rearwardly extending axis so that its notch 69 and 70 is located vertically above a different one of the fingers 63 and 64, respectively, on the feeler levers 59 and 60, respectively. When a notch 69 or 70 is located above a finger 63 or 64 on a feeler lever 59 or 60, the finger 63 or 64 can be urged upwardly into the notch 69 or 70 as the counterweighted end 57A or 58A of its feeler lever 59 or 60 moves downwardly about the first pin 61, so that the other end 57 or 58 of its feeler lever 59 or 60 moves upwardly about the first pin 61. Such upward movement of the one end 57 or 58 of the feeler lever 59 or 60: (1) urges upwardly the arm 54 or 56, respectively, of the T-shaped bar 52, resting on the one end 57 or 58 of the feeler lever 59 and 60; and (2) thereby urges upwardly the bar 52 and latch 46, so that the latch 46 moves above the locking opening 44 in the front wall 34 of the upper enclosure 30 and vertically out of the opening 50 in the tongue 48 on the extension 25 of the door 20, so that the door 20 is not held closed against the front wall 22 of the lower enclosure 14.

As shown in FIGS. 3, 4, 5 and 9, the coin operated mechanism 32 of this invention is mounted on a rigid frame, generally 71, in the upper enclosure 30 of the vending machine 10. The frame 71 is adapted to be precisely positioned in the upper enclosure 30 and, when necessary, removed from the upper enclosure (e.g., for repairing the coin operated mechanism). The coin operated mechanism 32, as mounted on the frame 71 in the upper enclosure 30, comprises: (1) a coin sorter of this invention, generally 72, positioned adjacent the front wall 34 of the upper enclosure 30, just below the coin insert slot 36 in the front wall of the upper enclosure; (2) a coin chute assembly, generally 73, positioned below the coin sorter 72 and containing three conventional, generally vertical, coin chutes 74, 76 and 78; (3) a coin totalizer of this invention, generally 80; (4) a vending controller, generally 81, which is connected to the totalizer 80 and which includes as its elements the feeler levers 59 and 60 and the circular cams 66 and 68; and (5) a conventional, laterally extending, trip wire 82, the ends 83 and 83A of which are connected to the coin chute assembly 73 and the coin totalizer 80, respectively.

In the vending machine 10 of this invention, the dimensions of the coin insert slot 36 in the front wall 34 of the upper enclosure 30 are preferably such that only coins that are no larger in size than a quarter, such as nickels, dimes and quarters, can pass through the slot. Coins, inserted in the slot 36, fall into the coin sorter 72 and are there separated into: (1) nickels which move down into the nickel chute 74; (2) dimes which move down into the dime chute 76; and (3) quarters which move down into the quarter chute 78. The use of a particular coin sorter is not required in the vending machine 10, and indeed, many types of conventional coin sorters can be utilized, such as the coin sorters disclosed in U.S. Pat. Nos. 2,292,628 and 3,921,779. Preferably, a coin sorter 72 of this invention is utilized as described below and shown in FIGS. 13 to 19. The coin sorter of this invention is adapted to: (1) reject slugs as well as coins of improper denominations such as pennies; and (2) rid itself of coins, slugs or other materials which become stuck in it.

As shown in FIGS. 5, 6, 7 and 9, the coin totalizer 80 and trip wire 82 of the coin operated mechanism 32 of this invention are positioned between two laterally extending, vertical plates, i.e., a front plate 84 and a rear plate 86. The front plate 84 is mounted on the frame 71 of the coin operated mechanism. On the rear of the front plate 84 are three rearwardly extending, elongated front spacers 87 about the periphery of the front plate 84. Each front spacer 87 has a rearwardly facing shoulder 88 on its rear portions. In the rear plate 86 are three holes 90, into which the rear portions of the three front spacers 87 can be inserted with their shoulders 88 abutting against the front of the rear plate 86. Also provided in the front and rear plates 84 and 86 is a central hole 92 and 94, respectively, in which a central rod 96 is located. Preferably, a bushing 98 is provided in the central hole 92 in the front plate 84, so that the front of the central rod 96 is supported by the front plate 84 but can rotate freely within its central hole 92. The first pin 61 is mounted on the rear of the rear plate 86 above its central hole 94.

As also shown in FIGS. 5, 6, 7 and 9, a retaining member 100 is located rearwardly of the rear plate 86. The rear of the central rod 96 extends through a central hole 102 in the retaining member 100, so that the rear of the central rod is supported by the retaining member. The retaining member 100 serves to hold the elements of the coin totalizer 80 and its front and rear plates 84 and 86 together in fixed positions about the central rod 96. The retaining member 100 also serves to hold elements of the vending controller 81 in fixed positions about the central rod 96 and rearwardly of the coin totalizer 80. In this regard, the front of the retaining member 100 is provided with a pair of frontally extending, elongated rear spacers 103. Each rear spacer 103 fits over the rear of one of the front spacers 87 on the front plate 84 where the front spacers 87 extend through the peripheral holes 90 in the rear plate 86. The rear spacers 103 can be suitably attached to the front spacers 87 by machine screws 103A extending frontally through the rear spacers 103 and into the rear of each front spacer 87.

As best shown in FIGS. 5, 6, 7 and 9, the coin totalizer 80 comprises a laterally extending lever 104 that is rotatably mounted on the central rod 96 between two annular grooves 105 in the rod 96 adjacent the rear of the front plate 84. The central rod 96 extends through a hole 106 in the center of the lever 104. One lateral end 107 of the lever 104 is connected to one lateral end 83A of the trip wire 82, and the other lateral end 107A of lever 104 is counterweighted. The lever 104 is held in place on the central rod 96 by a pair of retaining rings in the grooves 105 in the central rod 96.

Figure 6:
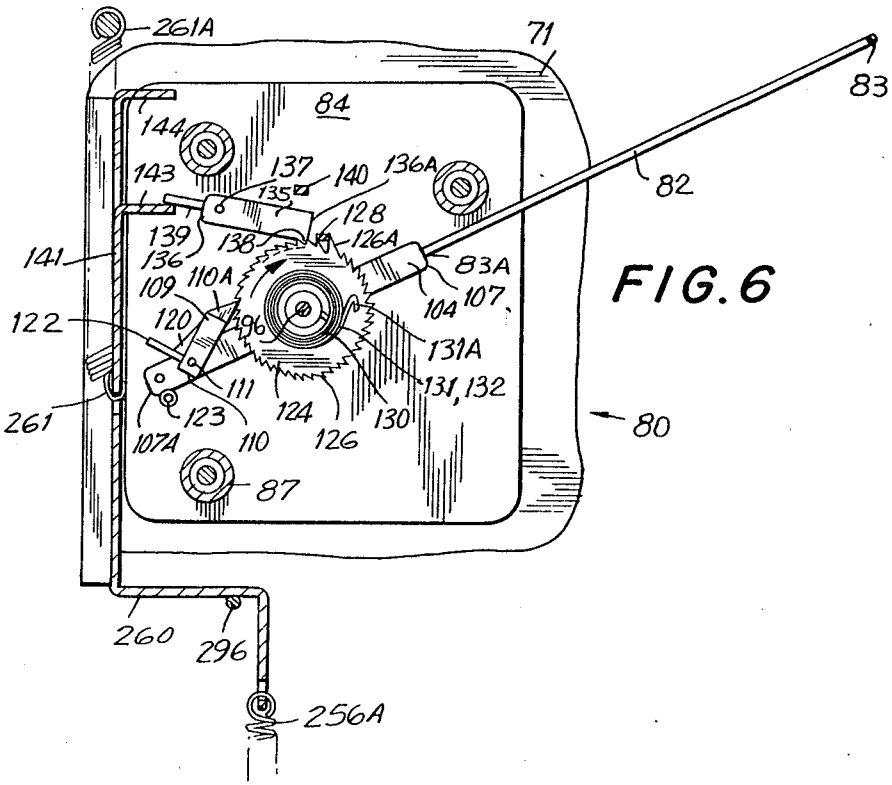
FIG. 6 is a section view, taken along line 6—6 in FIG. 5, of the totalizer.
Figure 5:
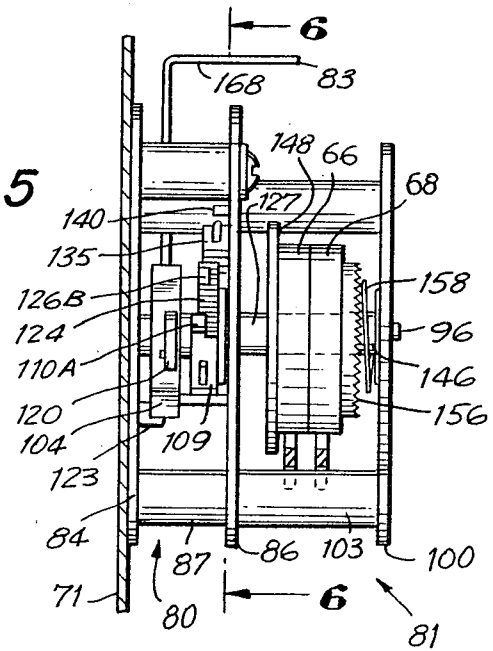
FIG. 5 is a section view, taken along line 5—5 in FIG. 4, of a totalizer of the coin operated mechanism.
Figure 7:
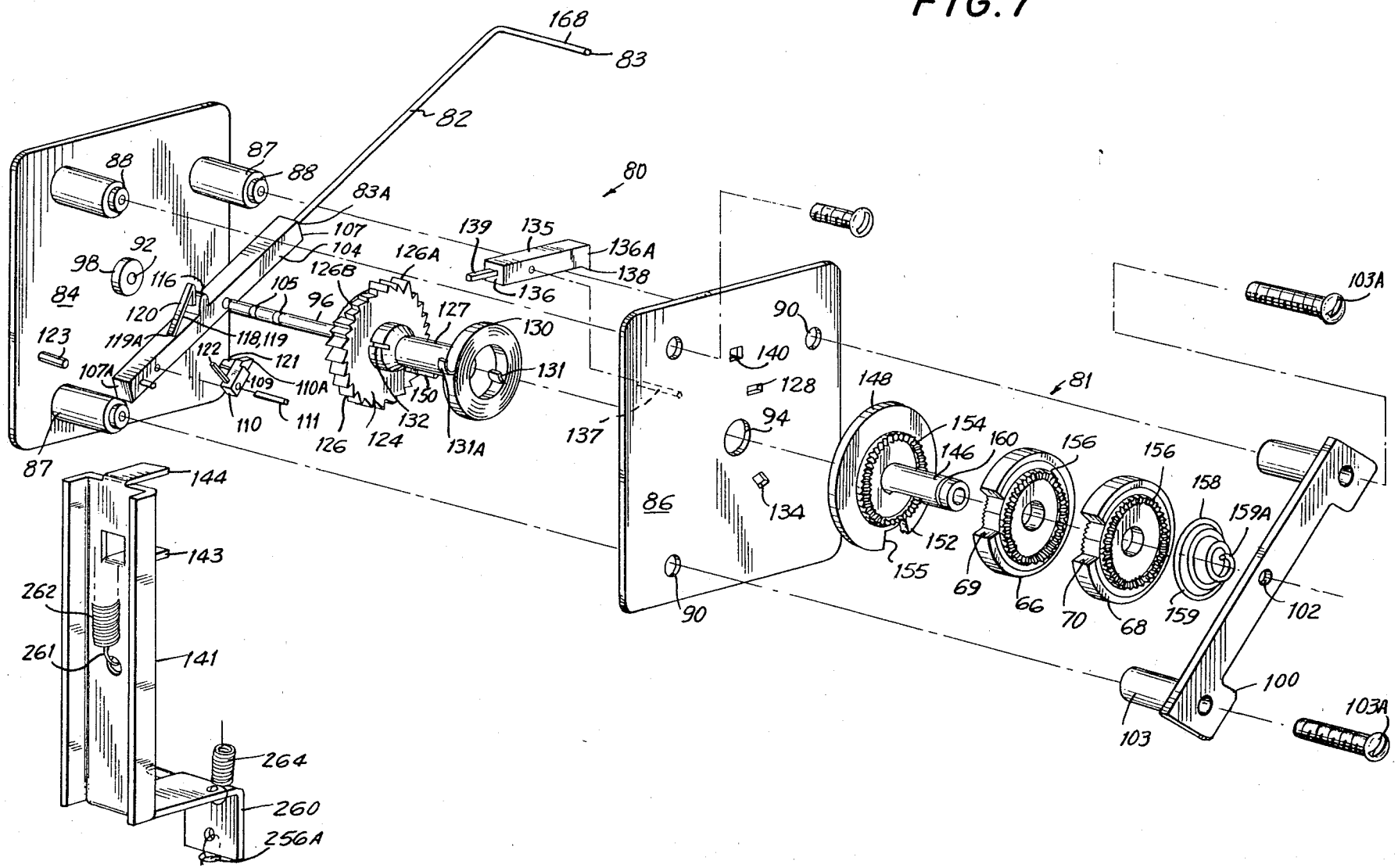
FIG. 7 is an exploded perspective view of the totalizer.

Adjacent the rear of the counterweighted lateral end 107A of the lever 104 is a laterally extending, lower dog 109. The lower dog 109 is rotatably mounted, adjacent one lateral end 110 thereof, on a second pin 111 that extends rearwardly from the rear of the counterweighted lateral end 107A of the lever 104. The other lateral end 110A of the dog 109 is beveled downwardly and laterally from the top of the dog 109 towards the central rod 96 as shown in FIGS. 6 and 7, and the beveled end 110A extends rearwardly from the front of the dog 109 to only about its middle as shown in FIGS. 5 and 7.

An upwardly extending finger 116 is provided on the top of the lever 104 in front of the beveled end 110A of the lower dog 109. A slot 118 is provided in the lateral side of the finger 116 facing the second pin 111. One lateral end 119 of a laterally extending, dog retaining spring 120 is inserted in the slot 118 of the finger 116, and the other lateral end 119A of the spring 120 rests on top of the lever 104.

The front of the lower dog 109, between the second pin 111 and its beveled end 110A, is provided with a frontally extending, first finger 121 which extends between the top of the lever 104 and the bottom of the dog retaining spring 120. The dog 109 also has a second finger 122 extending upwardly and laterally from the pivoted end 110 thereof.

A rearwardly extending stop 123 is provided on the rear of the front plate 84, below the counterweighted lateral end 107A of the lever 104. The stop 123 restricts counterclockwise rotation of the lever 104 about the central rod 96 (when viewed as in FIG. 6). In this regard, the lateral end 107A of the lever 104 is counterweighted, so that it rests on top of the stop 123 below the central rod 96 and the other lateral end 107 of the lever 104 is above the central rod 96 as shown in FIG. 6 when no coin is in coin chutes 74, 76 and 78 urging the end 83 of the trip wire 82 downwardly.

As shown in FIGS. 5, 6, 7 and 9, the totalizer 80 also comprises a ratchet wheel 124 that is rotatably mounted on the central rod 96, laterally of the beveled end 110A of the lower dog 109 and rearwardly of the lever 104. The ratchet wheel 124 has a plurality of gear teeth, generally 126, about its circumference and a rearwardly extending hub 127 about the central rod 96. The beveled end 110A of the dog 109 is adapted to engage the gear teeth 126 of the ratchet wheel 124 and to urge the gear teeth 126 to revolve clockwise with the dog 109 about the central rod 96 (when viewed as in FIG. 6). As seen from FIG. 5, the beveled end 110A of the dog 109 is preferably adapted to contact only the front portions of the gear teeth 126 on the ratchet wheel 124 and, when the lever 104 and the ratchet wheel 124 are not in motion, to fit between adjacent gear teeth 126.

As best seen in FIGS. 6 and 7, one of the gear teeth 126A on the ratchet wheel 124 is higher than the rest and is adapted to serve as a stop to limit counterclockwise rotation of the ratchet wheel 124 (when viewed as in FIG. 6). In this regard, a first frontally extending tab 128 is provided on the front of the rear plate 86. As shown in FIG. 6, the first tab 128 abuts against the one higher gear tooth 126A when the ratchet wheel 124 rotates counterclockwise about the central rod 96.

As best seen in FIGS. 5 and 7, several gear teeth 126B on the ratchet wheel 124 do not extend all the way from the rear to the front of the ratchet wheel. Such gear teeth 126B extend only from the rear to about the middle of the ratchet wheel and are located somewhat to the rear of the beveled end 110A of the lower dog 109. These half-gear teeth 126B form a gap between the gear teeth 126 at the front of the ratchet wheel 124. The beveled end 110A of the dog 109, which contacts only the front portions of the gear teeth 126, cannot contact the half-gear teeth 126B and cannot urge such gear teeth 126B to move clockwise (when viewed as in FIG. 6) with the beveled end 110A of the dog 109.

The lower dog 109 is adapted to move upwardly and to revolve clockwise a measured angle about the central rod 96 (when viewed as in FIG. 6) with the adjacent counterweighted end 107A of the lever 104 when the trip wire 82 and the other end 107 of the lever 104 are moved downwardly and are revolved clockwise the measured angle about the central rod 96 (when viewed as in FIG. 6). Such upward movement and clockwise revolution of the dog 109 about the central rod 96 initially causes its beveled end 110A to abut against the bottom of the gear tooth 126, directly above it on the ratchet wheel 124. This causes the beveled end 110A of the dog 109 to revolve in a clockwise direction (when viewed as in FIG. 6) about the second pin 111, mounted on its other end 110, until the bottom of its first finger 121 abuts against the top of the lever 104. Further such upward movement and clockwise revolution of the dog 109 about the central rod 96 causes its beveled end 110A to move with its other end 110 and the adjacent counterweighted end 107A of the lever 104, so that the top of the beveled end 110A of the dog 109 urges the gear tooth 126, directly above it, to revolve the measured angle about the central rod 96 in a clockwise direction (when viewed as in FIG. 6).

The lower dog 109 also is adapted to move downwardly and to revolve counterclockwise a measured angle about the central rod 96 (when viewed as in FIG. 6) with the adjacent counterweighted end 107A of the lever 104 when the trip wire 82 and the other end 107 of the lever 104 move upwardly and revolve counterclockwise about the central rod 96 (when viewed as in FIG. 6) under the weight of counterweighted end 107A of the lever. Such downward movement and counterclockwise revolution of the dog 109 about the central rod 96 can occur until the counterweighted end 107A of lever 104 comes to rest on the stop 123. This downward movement and counterclockwise revolution of the dog 109 causes the bottom of its beveled end 110A initially to abut against the top of the gear tooth 126, directly below it on the ratchet wheel 124. This causes the beveled end 110A of the lower dog 109 to revolve in a counterclockwise direction (when viewed as in FIG. 6) about the second pin 111, mounted on its other end 110, until its beveled end 110A has revolved counterclockwise out from between the pair of gear teeth 126 where it had been positioned and the top of its first finger 121 abuts against the bottom of the dog retaining spring 120. Further such downward movement and counterclockwise revolution of the dog 109 about the central rod 96 causes the bottom of its beveled end 110A to move downwardly along the tops of the gear teeth 126 and the circumference of the ratchet wheel 124 until the dog 109 stops with the lever 104 on the stop 123. Then, the beveled end 110A of the dog 109 moves downwardly and revolves clockwise (when viewed as in FIG. 6) about the second pin 111 under the weight of its beveled end 110A, so that its beveled end 110A falls downwardly between another pair of gear teeth 126. Thus, the ratchet wheel 124 does not rotate about the central rod 96 during such downward movement and counterclockwise revolution of the dog 109 about the central rod.

Mounted about the hub 127, to the rear of the ratchet wheel 124, is a torsion spring 130. The inner end 131 of the torsion spring 130 is located in a groove 132 in the hub 127, adjacent the rear of the ratchet wheel 124, and the outer end 131A of the torsion spring is attached to a frontally extending, second tab 134 on the front of the rear plate 86. The torsion spring 130 is adapted to rotate the ratchet wheel 124 about the central rod 96 in a counterclockwise direction (when viewed as in FIG. 6) when the ratchet wheel 124 is otherwise free to rotate.

As shown in FIGS. 5, 6 and 7, the totalizer 80 also comprises a laterally extending upper dog 135 above the central rod 96 and the lower dog 109 and on the same lateral side of the central rod as the lower dog. The upper dog 135 is rotatably mounted, adjacent one lateral end 136 thereof, on a third pin 137 that extends frontally from the front of the rear plate 86. Beneath the other lateral end 136A of the upper dog 135 is a downwardly extending, beveled first finger 138. The beveled finger 138 is adapted to fall downwardly, under the weight of the end 136A of the upper dog 135, between adjacent gear teeth 126 on the top of the ratchet wheel 124, including the half-gear teeth 126B, to restrict counterclockwise rotation of the ratchet wheel about the central rod 96 (when viewed as in FIG. 6). In this regard, the beveled finger 138 of the upper dog 135 can prevent the ratchet wheel 124 from rotating counterclockwise with downward movement and counterclockwise revolution of the lower dog 109 about the central rod 96. A second finger 139 extends laterally from the pivoted end 136 of the upper dog 135.

A frontally extending, third tab 140 is provided on the front of the rear plate 86. The third tab 140 is located above the upper dog 135, adjacent its beveled end 136A. The third tab 140 serves to restrict rotation of the upper dog 135 in a counterclockwise direction about the third pin 137 (when viewed as in FIG. 6).

As shown in FIGS. 3, 6, 7 and 9, the totalizer 80 also comprises a vertically elongated, first slider 141 located laterally of the pivoted ends 110 and 136 of the lower and upper dogs 109 and 135. The slider 141 is adapted to move vertically past the lower and upper dogs 109 and 135 in a vertical channel 142 in the frame 71 of the coin operated mechanism 32 of this invention. The slider 141 has a pair of parallel fingers 143 and 144 at the bottom and top thereof, extending laterally towards the lower and upper dogs 109 and 135, respectively. The slider fingers 143 and 144 are adapted to urge downwardly the second fingers 122 and 139, respectively, on the pivoted ends 110 and 136, of the dogs 109 and 135 when the slider 141 is moved downwardly, so as to: (1) cause the second fingers 122 and 139 of the dogs to move downwardly and revolve counterclockwise (when viewed as in FIG. 6) about the pins 111 and 137, respectively; and (2) thereby cause corresponding upward movement and counterclockwise revolution of the beveled ends 110A and 136A of the dogs, so that such beveled ends move out of engagement with the gear teeth 126 of the ratchet wheel 124.

Figure 9:
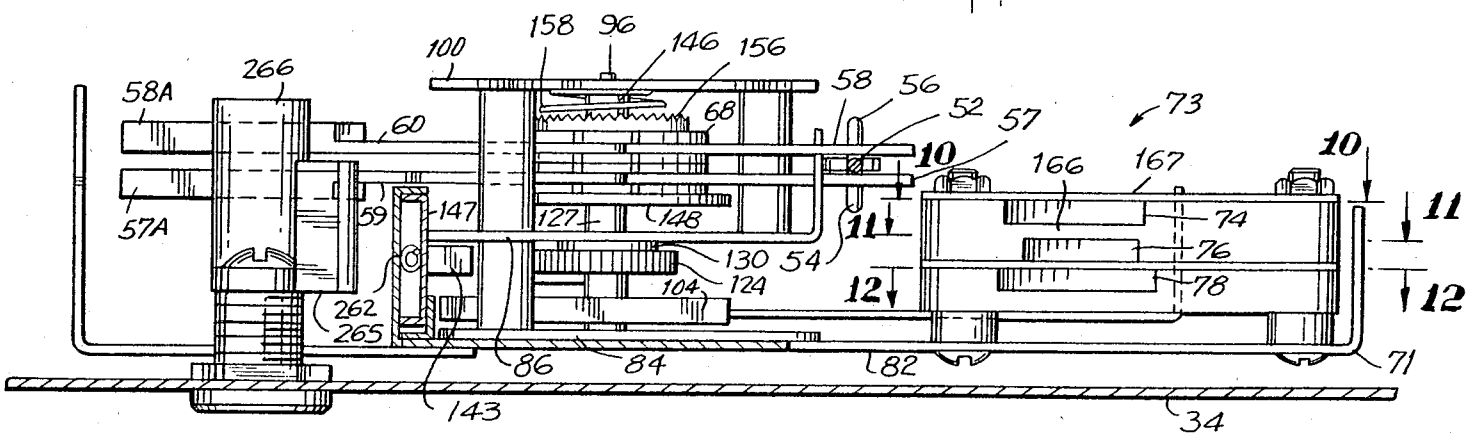
FIG. 9 is a section view, taken along line 9—9 in FIG. 8, showing the bottom of a coin chute assembly and the totalizer of the coin operated mechanism.

As shown in FIGS. 5, 7 and 9, the hub 127 of the ratchet wheel 124 extends rearwardly through the central hole 94 of the rear plate 86 and into the hub 146 of a conventional price wheel 148 of the vending controller 81. The inside diameter of the hub 146 of the price wheel 148 preferably mates with the outside diameter of the ratchet wheel hub 127, and the rear of the price wheel hub 146 is preferably located adjacent the front of the retaining member 100. A rearwardly extending key 150 on the outside of the ratchet wheel hub 127 fits into a rearwardly extending groove 152 within the price wheel hub 146, so that rotation of the ratchet wheel hub 127 about the central rod 96 causes corresponding rotation of the price wheel 148. The rear of the price wheel 148 is provided with a conventional set of gear teeth 154 extending annularly about the price wheel hub 146. A notch 155 is also preferably provided in the circumferential edge of the price wheel 148. The notch 155 is preferably located on the bottom of the price wheel when the higher gear tooth 126A abuts against the first tab 128.

Rotatably mounted about the central rod 96 and the price wheel hub 146, adjacent the rear of the price wheel 148, are the circular cams 66 and 68 which also comprise elements of the vending controller 81. Extending annularly about the price wheel hub 146 on the front and rear of each cam 66 and 68 are conventional sets of gear teeth 156. The adjacent sets of gear teeth 156 on the cams 66 and 68 mate with one another as well as with the set of gear teeth 154 on the price wheel 148.

The circular cams 66 and 68 are urged frontally against each other and against the rear of the price wheel 148 by a conical coil spring 158. The spring 158 is wrapped about the rear portions of the price wheel hub 146 and urges the rearmost cam 68 frontally. In this regard, the base 159 of the spring 158 contacts the rear of cam 68, and the vertex 159A of spring 158 is located in a groove 160 in the outer surface of the price wheel hub 146 at the rear thereof. Rotation about the central rod 96 of the ratchet wheel 124 and its hub 127 and key 150 results in corresponding rotation of the groove 152, the price wheel hub 146, and the price wheel 148 with its set of gear teeth 154. Such rotation of the price wheel gear teeth 154, caused by rotation of the ratchet wheel 124, results in corresponding rotation of the sets of gear teeth 156 on the circular cams 66 and 68 and corresponding rotation of the notches 69 and 70, respectively, on the cams—unless the cam gear teeth 156 are disengaged from the price wheel gear teeth 154. The cams 66 and 68 can be disengaged from the price wheel 148 by pulling one or both cams rearwardly of the price wheel against the force of the spring 158 to disengage their gear teeth 154 and 156. For example, the cams 66 and 68 can be pulled rearwardly to disengage them from the price wheel 148 and from each other when the cam notches 69 and 70 are to be angularly displaced about the central rod 96 from one another and from the price wheel notch 155 to angular positions about the central rod associated with different prices for newspapers or the like, to be vended. In this regard, when the notch 155 is at the bottom of the price wheel 148, one cam notch (e.g., front notch 69 in FIGS. 4 and 8) can represent a higher price than the other cam notch (e.g., rear notch 70 in FIGS. 4 and 8) by angularly displacing the one cam notch further from the price wheel notch 155 in a counterclockwise direction (when viewed as in FIG. 4) than the other cam notch.

Figure 12:
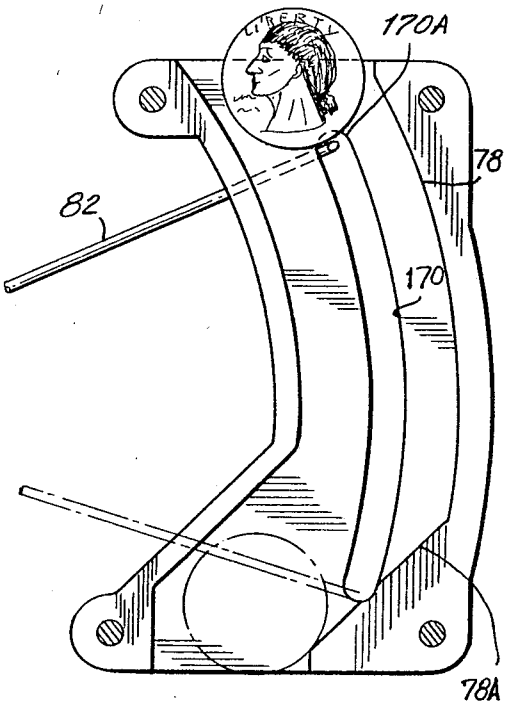
FIGS. 10 to 12 are section views, taken along lines 10—10, 11—11 and 12—12, respectively, in FIG. 9, showing a nickel chute, a dime chute and a quarter chute, respectively, in the coin chute assembly.
Figure 11:
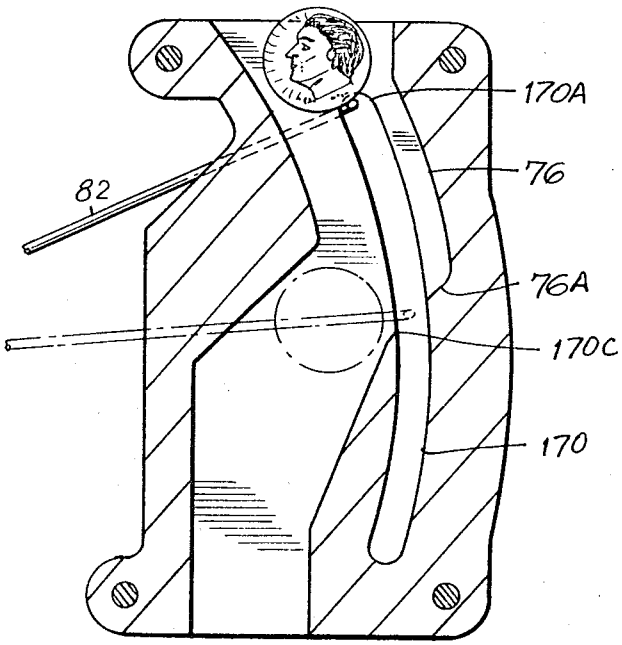
Figure 10:
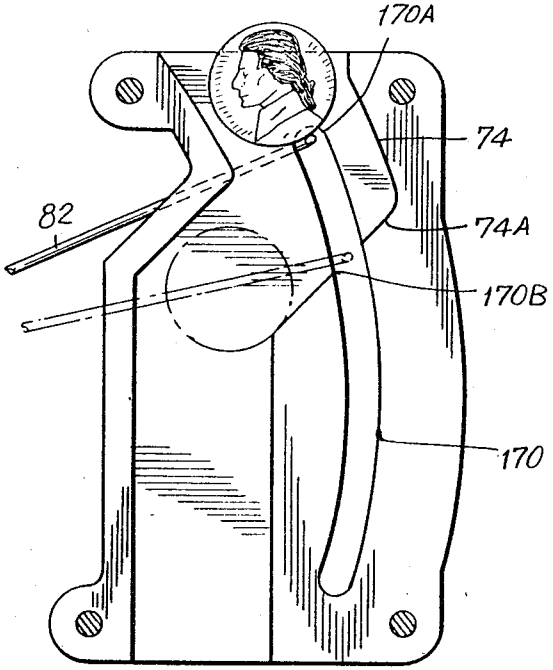
Figures 15, 16, 17, 18, 19:
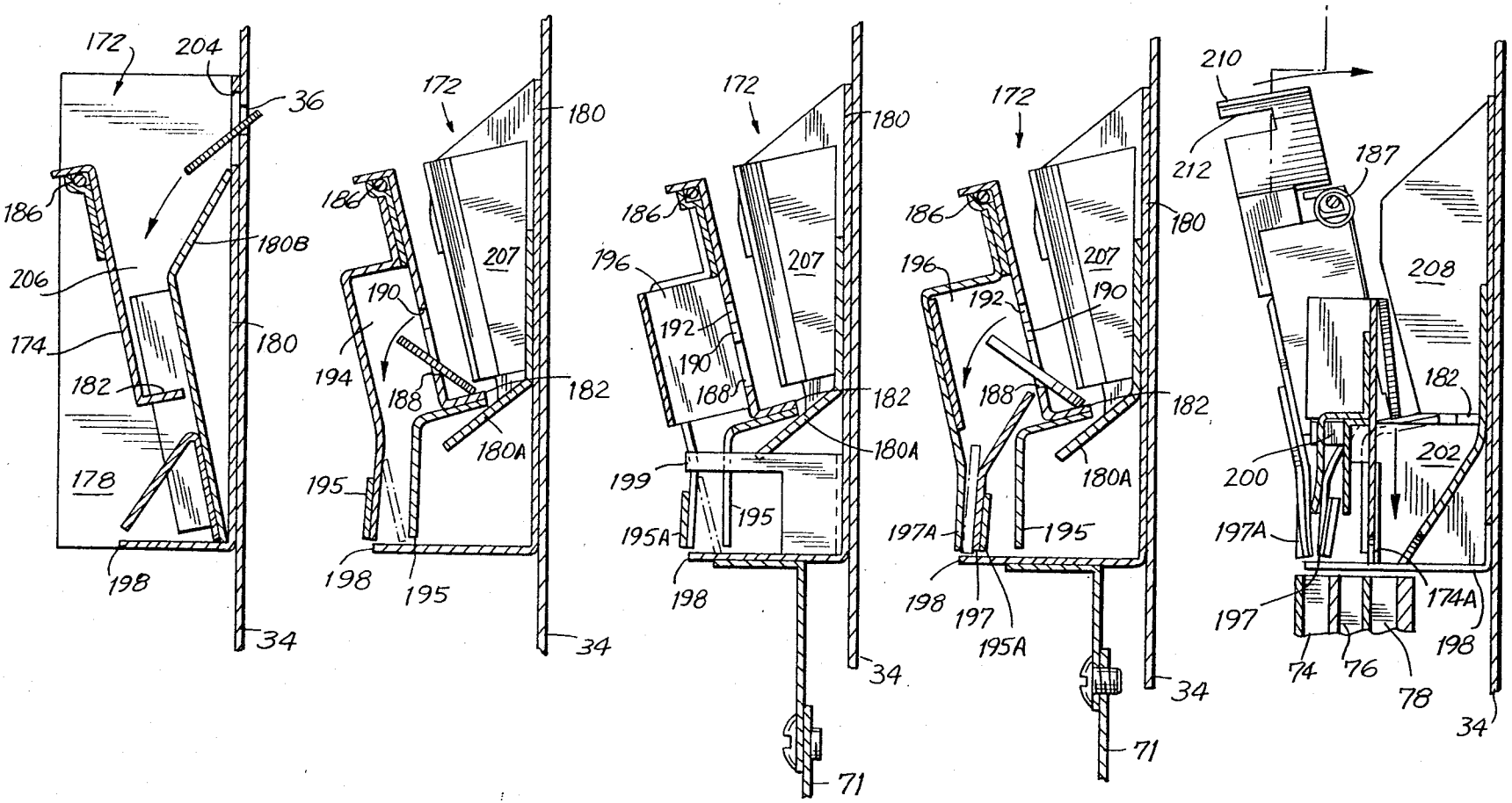

Shown in FIGS. 10 to 12 are the coin chutes 74, 76 and 78 of the coin chute assembly 73 of the coin operated mechanism 32. As shown in FIGS. 4, 8, 9 and 19, the coin chute assembly 73 is positioned below the coin sorter 72, laterally of the coin totalizer 80 and to the rear of the laterally extending portions of the trip wire 82. As shown in FIGS. 9 and 19, the dime chute 76 is in front of the nickel chute 74 and to the rear of the quarter chute 78. Adjacent coin chutes 74, 76 and 78 are separated by laterally extending partitions 166 between the chutes, and the front and rear of the coin chute assembly 73 are covered by coverplates 167. A generally vertical, arcuate slot 170 extends rearwardly through the coin chute assembly 73 and through at least part of each coin chute 74, 76 and 78. In this regard: (1) the slot 170 intersects the nickel chute 74 from the upper end 170A of the slot to a lower point 170B in the slot, the distance between the points 170A and 170B in the slot 170 representing approximately 20% of the entire length of the slot 170; (2) the slot 170 also intersects the dime chute 76 from its upper end 170A to a still lower point 170C in the slot, the distance between the points 170A and 170C representing approximately 40% of the entire length of the slot 170; and (3) the slot 170 also intersects the quarter chute 78 throughout the entire length of the slot 170.

As shown in FIGS. 5 and 9, one lateral end 83 of the trip wire 82 extends rearwardly of the slot 170 and the coin chutes 74, 76 and 78. In this regard, a portion 168 of the trip wire 82, adjacent its lateral end 83, extends rearwardly in slot 170 through the part of each coin chute 74, 76 and 78 where the slot 170 intersects the coin chute. This trip wire portion 168 is adapted to underlie, and to be urged downwardly by, each coin falling through the coin chute assembly 73 while the coin is falling through the part of one of the coin chutes 74, 76 or 78 that is intersected by the slot 170.

As also shown in FIGS. 10 to 12, a shoulder 74A, 76A and 78A is provided in each coin chute 74, 76 and 78, respectively. Each shoulder 74A, 76A and 78A is angled downwardly towards the coin totalizer 80, and each shoulder intersects the slot 170 where the intersection ends of the slot 170 with each chute 74, 76 and 78. Each shoulder 74A, 76A and 78A is adapted to disengage a coin, falling though its coin chute 74, 76 and 78, from the trip wire portion 168, underlying the coin.

Shown in FIGS. 13 to 19 is a preferred coin sorter 72 of this invention. The coin sorter 72 comprises a trough, generally 172, which extends laterally and downwardly from the bottom of the coin insert slot 36 in the front wall 34 of the upper enclosure 30 to the top of the coin chute assembly 73. The trough 172 of the coin sorter 72 is formed by four upstanding walls 174, 176, 178 and 180 and a base 182. The coin sorter 72 is mounted on the frame 71 of the coin operated mechanism 32 so that a laterally extending, front wall 180 of the coin sorter is parallel to, and abuts against, the front wall 34 of the upper enclosure 30. The top of a laterally extending, rear wall 174, is rotatably connected to a laterally extending, first rod 186, so that the bottom of the rear wall 174 can be moved rearwardly away from the front wall 180 by rotating the rear wall about the first rod 186 to open the bottom of the trough 172. The lateral ends of the first rod 186 are mounted in the rear top corners of two side walls 176 and 178 that are adjacent to the lateral ends of the front wall 180 and that extend rearwardly from the front wall 180. The base 182 is connected to the bottom of the movable rear wall 174, so that the base 182 can move rearwardly away from the front wall 180 with the bottom of the rear wall 174. A spring 187 is provided about the first rod 186, and the ends of the spring are connected to a lateral top corner of the rear wall 174 and to a rear top corner of the adjacent side wall 176. The spring 187 serves to urge the rear wall 174 to revolve about the first rod 186, so that the bottom of the rear wall 174 and the base 182 thereon are urged towards the front wall 180 to close the bottom of the trough 172. In this regard, the front edge of the base 182 is preferably urged frontally by the spring 187, so that, when the bottom of the trough 172 is closed, the base 182 is adjacent to a rearwardly and downwardly extending projection 180A on the rear of the front wall 180.

As shown in FIGS. 13 to 19, three generally rectangular, coin slots 188, 190 and 192 are provided in side-by-side relationship along the lateral length of the rear wall 174. The top of the first slot 188 is spaced above the base 182 by a distance less than the diameter of a dime. The top of the second slot 190 is spaced above the base 182 by a distance greater than the diameter of a dime but smaller than the diameter of a nickel. The top of the third slot 192 is spaced above the base 182 by a distance greater than the diameter of a nickel but smaller than the diameter of a quarter. The bottom of each slot 188, 190 and 192 is spaced above the base 182. In front of each slot 188, 190 and 192 is the projection 180A on the front wall 180.

As shown in FIGS. 8 and 13 to 18, the first slot 188 in the rear wall 174 is in communication with the interior of the upper enclosure 30. Any coin or slug, smaller than a dime, will fall through the first slot 188. The second slot 190, through which dimes will fall, is in communication with a dime channel 194 which is mounted on the rear wall 174 outside of the trough 172 and to the rear of the second slot 190. The dime channel 194 runs from the second slot 190 down to a point above, and laterally adjacent to, the dime chute 76 in the coin chute assembly 73. The dime channel 194 is formed from a pair of laterally extending, upstanding parallel side panels 195 and 195A. The third slot 192, through which nickels will fall, is in communication with a nickel channel 196 which is mounted on the rear wall 174 outside of the trough 172 and to the rear of the third slot 192. The nickel channel 196 runs from the third slot 192 down to a point above, and laterally adjacent to, the nickel chute 74 in the coin chute assembly 73. The nickel channel 196 is formed from a pair of laterally extending, upstanding parallel side panels 197 and 197A. The bottom of the dime channel 194 and the bottom of the nickel channel 196 are formed by a common bottom panel 198. The bottom panel 198 is mounted on the rear of the front wall 180 beneath its projection 180A, and the bottom panel 198 extends rearwardly beneath the side panels 195, 195A, 197 and 197A of the dime and nickel channels 194 and 196. Extending rearwardly across the top of the dime channel 194, from the front to the rear side panels 195 and 195A thereof, is a penny stop 199. The penny stop 199 is spaced above the bottom wall 198 of the dime channel 194 by a distance greater than the diameter of a dime but less than the diameter of a penny. Extending rearwardly across the top of the nickel channel 196, from the front to the rear side panels 197 and 197A thereof, is a slug stop 200. The slug stop 200 is spaced above the bottom wall 198 of the nickel channel 196 by a distance greater than the diameter of a nickel but less than the diameter of a quarter.

Figure 13:
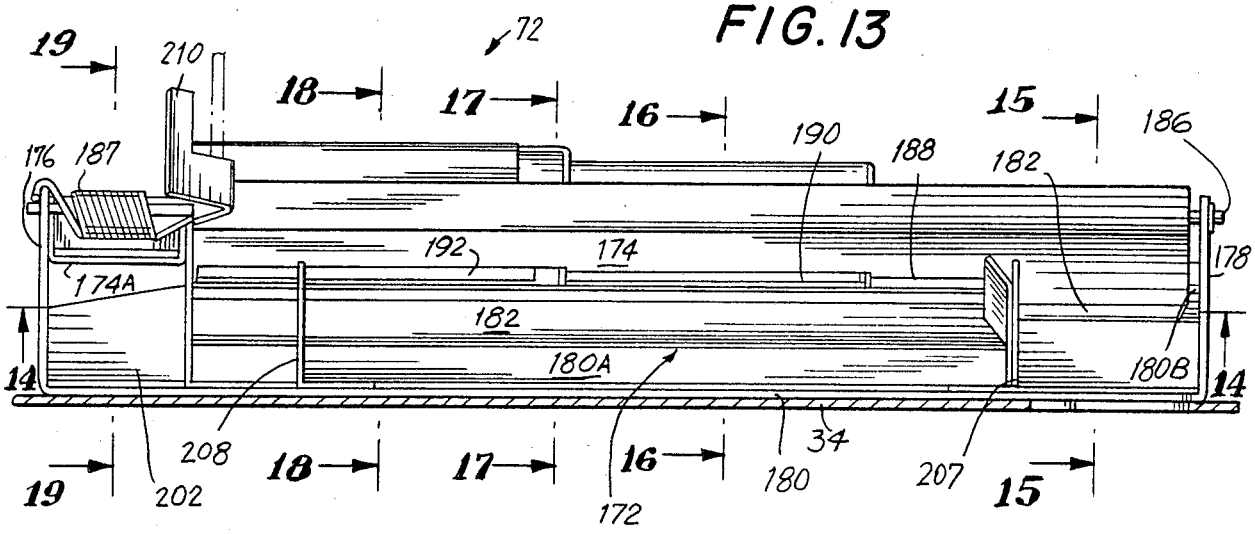
FIG. 13 is a top view of a coin sorter of the coin operated mechanism, taken along line 13—13 in FIG. 8.
Figure 14:
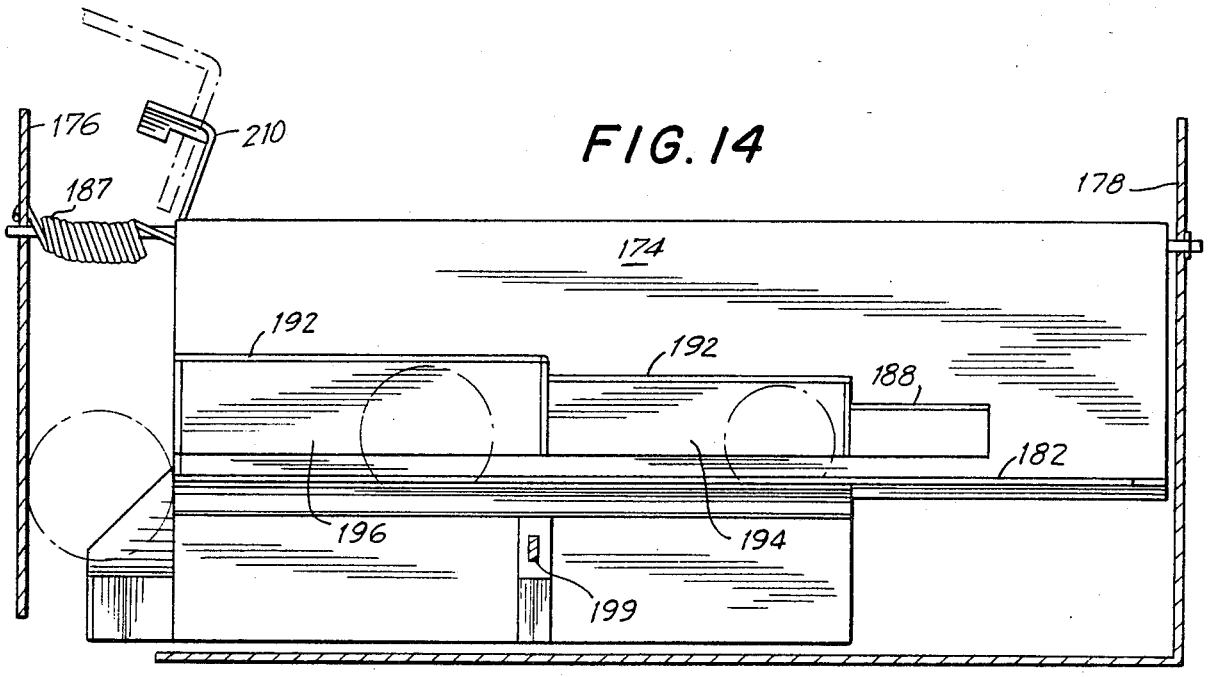
FIGS. 14 to 19 are section views of the coin sorter, taken along lines 14—14, 15—15, 16—16, 17—17, 18—18 and 19—19, respectively, in FIG. 13.

As shown in FIGS. 13 and 14, the base 182 in trough 172 of coin sorter 72 extends laterally from side wall 178 only to the lateral end of the third slot 192, closest to the side wall 176, and the base 182 does not extend all the way to the side wall 176. Similarly, the rear wall 174 extends laterally from side wall 178 only to the lateral end of the base 182 and the third slot 192 and not all the way to the side wall 176. Between the side wall 176 and the adjacent lateral end of the rear wall 174 is a laterally extending, upstanding rear wall member 174A mounted on the side wall 176. The rear wall member 74A, the side wall 176, the adjacent lateral portions of the front wall 180 and the adjacent lateral edge of the base 182 define a downwardly extending quarter channel 202. As shown in FIG. 19, the quarter channel 202 extends downwardly from the trough 172 to a point above the quarter chute 78 of the coin chute assembly 73.

As shown in FIGS. 4, 8, 13 and 15, a coin slot 204 is preferably provided in the front wall 180 of the coin sorter 72, adjacent its side wall 178. The slot 204 is adapted to be positioned directly to the rear of the coin insert slot 36 in the front wall 34 of the upper enclosure 30. The slot 204 is located in the coin sorter 72 directly above a downwardly extending coin channel 206 within the trough 172. The coin channel 206 is defined by: (1) the side wall 178; (2) the adjacent lateral portions of the rear wall 174; (3) an upstanding partition 207 that is mounted on, and extends rearwardly from, the front wall 180 within the trough 172; and (4) a second downwardly and rearwardly extending projection 180B on the front wall 180 beneath the slot 204. When the trough 172 is closed, the rear of the partition 207 is spaced from the rear wall 174 by no more than about the thickness of a nickel as shown in FIGS. 16 to 18. Thereby, only one coin at a time can roll downwardly and laterally in the trough 172 along the base 182 between the partition 207 and the rear wall 174. As seen in FIG. 15, the coin channel 206 is angled downwardly and rearwardly from the slot 204 so that a coin, deposited in the coin insert slot 36, will pass through the slot 204 and then fall down the coin channel 206, along the second front wall projection 180B, until the coin lands on the base 182 adjacent the rear wall 174.

As shown in FIGS. 15 to 19, the base 182 of the coin sorter 72, when mounted on frame 71 and positioned in the upper enclosure 30 of vending machine 10, is preferably inclined upwardly from the rear wall 174 towards the front wall 180 so as to form an acute angle, such as about 5° to 30°, with the horizontal when the bottom of the trough 172 is closed. Preferably, the movable rear wall 174 is at about a 90° angle to the base 182, and the front wall 180 is vertical. As a result, the rear wall 174 is inclined rearwardly at an acute angle, such as about 5° to 30°, to the front wall 180 when the bottom of the trough 172 is closed. Thereby, a coin, deposited in the coin insert slot 36 and falling through the slot 204 and the coin channel 206 in the trough 172, will land with its edge on top of the base 182 and with one of its faces contacting the rear wall 174 and inclined rearwardly. Thereafter, the face of the coin will continue to contact the rear wall 174 as the coin moves laterally on the base 182 until the coin falls into one of the slots 188, 190 and 192 in the rear wall 174 or it reaches the end of base 182 and falls into the quarter channel 202.

As also shown in FIGS. 4 and 8, the coin sorter 72 and the base 182 of its trough 172, when mounted on frame 71 and positioned in the upper enclosure 30, are also preferably angled laterally downward from the side wall 178 towards the side wall 176. As a result, the base 182 forms an acute angle, such as about 5° to 30°, with the horizontal. Thereby, a coin, falling into the trough 172 through the coin slot 204 and coin channel 206, with its edge on the base 182 and one of its faces contacting the rear wall 174, will roll downwardly under its own weight past the partition 207 along the base 182 until the coin falls through one of the coin slots 188, 190 or 192 or it reaches the end of the base 182 and falls into the quarter channel 202.

As shown in FIGS. 13 and 19, a rearwardly extending baffle 208 is preferably mounted on the front wall 180 within the trough 172. The baffle 208 is preferably located near the lateral end of the base 182 adjacent the quarter channel 202. When the bottom of the trough 172 is closed, the baffle 208 is spaced from the rear wall 174 by more than the thickness of one quarter but less than the thickness of two quarters. Thereby, only one quarter at a time can roll laterally downward along the base 182 between the baffle 208 and the rear wall 174 and into the quarter channel 202.

As further shown in FIGS. 4, 8, 13, 14, 19 and 20, a finger 210 is mounted on the outside of the rear wall 174, extending above the top of the rear wall and the first rod 186. A notch 212 in the rear of the finger 210, above the rear wall 174 and the first rod 186, is adapted to be urged frontally, so as to cause: (1) the rear wall 174 to rotate about the first rod 186 against the tension of spring 187; and (2) the bottom of the rear wall 174, along with the base 182, to move rearwardly away from the front wall 180 to open the bottom of the trough 172. Such rearward movement of the bottom of the rear wall 174 causes the side panels 195 and 195A of the dime channel 194 and the side panels 197 and 197A of the nickel channel 196 to move rearwardly away from the front wall 180 and the bottom panel 198, so that the bottom panel 198 is to the front of, and no longer underlies, the side panels 195, 195A, 197 and 197A.

Figure 22:
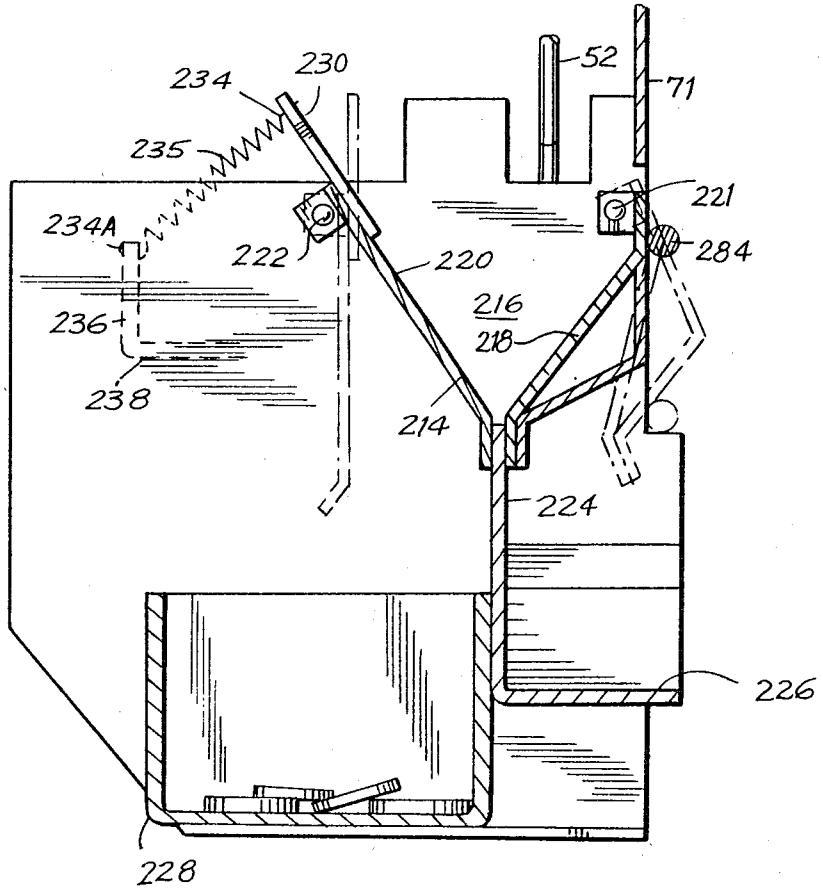
FIG. 22 is a section view, taken along line 22—22 in FIG. 4, of the side of the coin operated mechanism shown in FIG. 20.

As shown in FIGS. 3, 4 and 22, an escrow container, generally 214, is mounted on the frame 71 of the coin operated mechanism 32 beneath the coin chute assembly 73. The escrow container 214 forms part of the vending controller 81 and is adapted to hold coins which fall through the coin chutes 74, 76 and 78 before a newspaper or the like is vended. The escrow container 214 is also adapted to hold any coin or slug which falls through the first slot 188 in the rear wall 174 of the coin sorter 72. In this regard, a deflector (not shown) is provided on the rear wall (not shown) of the upper enclosure 30 for guiding any slug or coin, falling through the first slot 188, into the escrow container 214.

The escrow container 214 comprises a pair of parallel, rearwardly extending, upstanding side walls 216 and 217 which form part of the frame 71. The escrow container 214 also comprises a pair of laterally extending, upstanding front and rear walls 218 and 220, respectively, which converge at their bottoms. The tops of the front and rear walls 218 and 220 are rotatably mounted on the side walls 216 and 217 of the escrow container 214. In this regard, the tops of the front and rear walls 218 and 220 are connected (e.g., welded) to pairs of laterally extending, parallel second and third rods 221 and 222, respectively, which are rotatably mounted in holes in the side walls 216 and 217. The bottoms of the front and rear walls 218 and 220 of the escrow container 214 abut against the front and rear, respectively, of the top of an upstanding, laterally extending, divider panel 224 which also forms part of the frame 71 beneath the escrow container 214.

Figure 21:
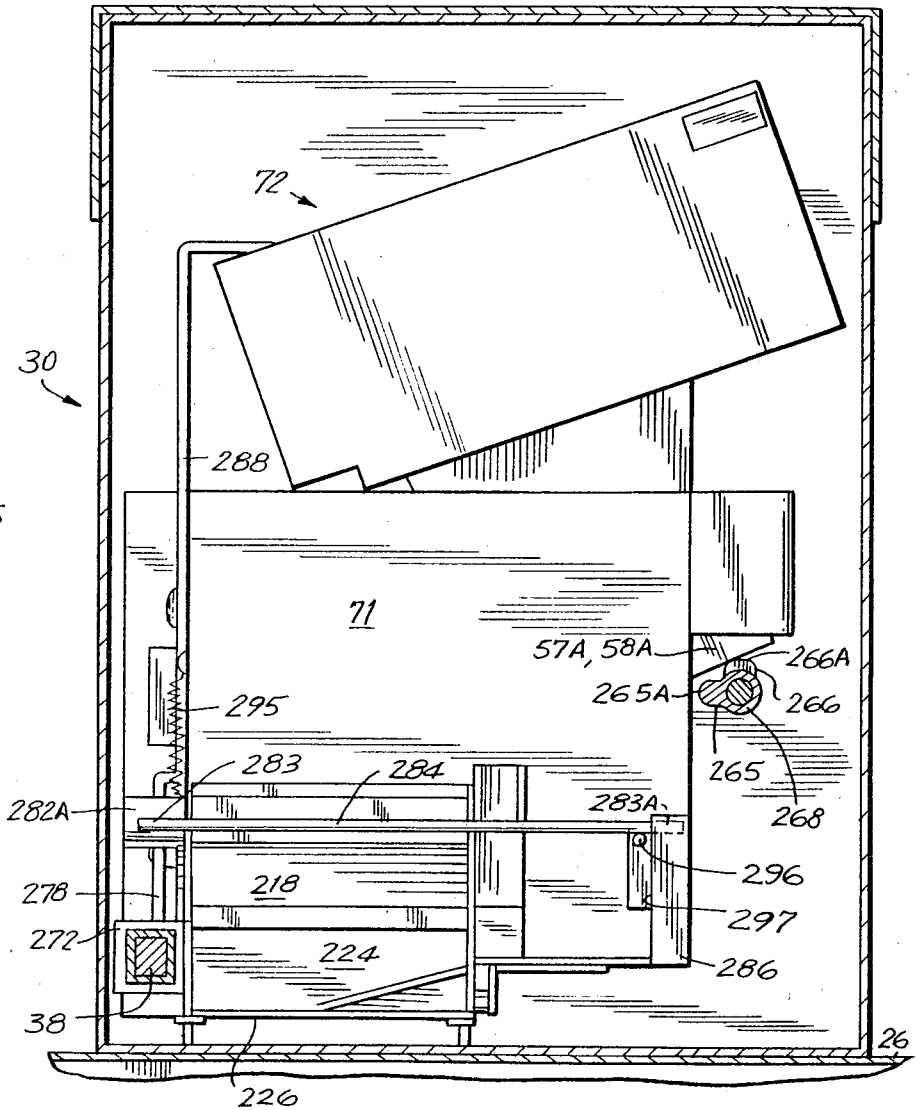
FIG. 21 is a section view of the front of the coin operated mechanism, taken along line 21—21 in FIG. 20.

As shown in FIGS. 21 and 22, a ledge 226 is provided beneath the front wall 218 of the escrow container 214. The ledge 226 is mounted on the front of the divider panel 224, and it extends frontally to the coin return opening 42 in the front wall 34 of the upper enclosure 30. The ledge 226 is adapted to hold coins which fall from the escrow container 214, so that the coins can be retrieved through the coin return opening 42 when no newspaper or the like has been vended.

As shown in FIGS. 3, 4 and 22, a conventional coin box 228 is provided beneath the rear wall 220 of the escrow container 214, to the rear of the divider panel 224. The coin box 228 is adapted to hold coins which fall from the escrow container 214 in payment of a newspaper or the like which has been vended.

As also shown in FIGS. 3, 4 and 22, an upwardly extending finger 230 is provided on the top of the rear wall 220 of the escrow container 214. The finger 230 extends above the third rod 222, mounted on the top of the rear wall 220, and is provided with an extension 232 at its top, extending laterally towards the coin totalizer 80. The finger extension 232 extends laterally past the side wall 216 of the escrow container 214 to a point rearwardly of the locking opening 44 in the front wall 34 of the upper enclosure 30. The front end 234 of a rearwardly and downwardly extending spring 235 is connected to the lateral end of the finger extension 232, and the rear end 234A of the spring 235 is connected to the top of an upwardly extending projection 236 on the rear of a frontally extending, second slider 238. The spring 235 is adapted to urge the finger 230 rearwardly when the slider 238 is in its rearmost position as shown in FIGS. 3 and 4, so that: (1) the rear wall 220 of the escrow container is urged to rotate about the third rod 222 in a counterclockwise direction (when viewed as in FIG. 22); and (2) thereby, the bottom of the rear wall 220 is urged frontally toward the bottom of the front wall 218 and against the top of the divider 224.

The second slider 238 is mounted on the side wall 216 of the escrow container 214, outside of the escrow container, and can move along the side wall 216 frontally toward, and rearwardly away from, the locking opening 44 in the front wall 34 of the upper enclosure 30. The slider 238 comprises a flat elongated downwardly extending member 240 which extends frontally from one lateral side of the projection 236. The downwardly extending member 240 has a pair of elongated slots 242 extending frontally of the projection 236. Located in each slot 242 is a laterally extending screw 244 which is screwed into a threaded hole in the side wall 216 of the escrow container 214. Each slot 242 is located about a shoulder on one of the screws 244, between the thread and the head thereof, so that the downwardly extending member 240 is held onto, and can slide along, the side wall 216 between the side wall 216 and the heads of the screws 244.

The second slider 238 also comprises a flat elongated horizontal member 246 which projects frontally from slider 238 towards the locking opening 44 in the front wall 34 of the upper enclosure 30. The horizontal member 246 is connected to the top of the downwardly extending member 240 and extends frontally from the same lateral side of the slider 238 as the downwardly extending member 240.

Attached to the second slider 238, adjacent its lateral side opposite its downwardly extending member 240, is the rear end 247 of a frontally extending spring 248. The front end 247A of the spring 248 is connected to the frame 71 of the coin operated mechanism 32 of this invention, so that the spring 248 urges the slider 238 to move frontally towards the locking opening 44.

As shown in FIGS. 3, 4 and 8, the bottom 250 of an upstanding lever 252 is rotatably mounted on the side wall 216 of the escrow container 214, beneath the slider 238. The top 250A of the lever 252 is located above the slider 238, between the lateral sides of the slider 238 and between its horizontal member 246 and the spring 248. Between the top and bottom 250 and 250A of the lever 252 is a curved projection 254 on the lever 252. The curved projection 254 extends frontally and laterally of the lever 252, away from the slider 238. The bottom end 256 of a first vertically aligned spring 258 is connected to the front of the curved projection 254. The top end 256A of the spring 258 is attached to the bottom end of a projection 260 on the bottom of the first slider 141. The bottom end of the projection 260 extends downwardly and laterally away from the first slider 141, towards the second slider 238. As shown in FIGS. 3, 6 and 7, the middle of the first slider 141 is connected to the bottom end 261 of a second vertically aligned spring 262. The top end 261A of the second spring 262 is connected to the vertical channel 142 in the frame 71 above the first slider 141. The first and second sliders 141 and 238, the lever 252 and the springs 248, 258 and 262, connected to them, are adapted, so that the first slider 141 is moved downwardly in the vertical channel 142 when the second slider 238 is moved frontally by the spring 248 towards the locking opening 44, so as to cause in succession: (1) the top 250A of the lever 252 to move frontally; (2) the front of the projection 254 on the lever 252 to move downwardly; and (3) the bottom end 256 of the first spring 258 to move downwardly.

As shown in FIGS. 3 and 4, the top end 263 of a third vertically aligned spring 264 is connected to both feeler levers 59 and 60 between the first pin 61 and the one end 57 and 58 of each feeler lever. The bottom end 263A of the third spring 264 is attached, above the top end 256A of the first spring 258, to the projection 260 on the bottom of the first slider 141. The third spring 264 is adapted to urge the one end 57 and 58 of each feeler lever 59 and 60 downwardly, away from the circular cams 66 and 68, when the second slider 238 is moved frontally by the spring 248, so as to cause in succession: (1) the top 250A of the lever 252 to move frontally; (2) the front of the projection 254 on the lever 252 to move downwardly; (3) the bottom end 256 of the first spring 258 to be urged downwardly; and (4) the projection 260 on the first slider 141 to move downwardly.

Mounted within the upper enclosure 30 are two rearwardly extending cams or stops 265 and 266 on a rearwardly extending shaft 268 mounted on the price selector lock 40 as shown in FIGS. 3, 4, 8, 9 and 21. Curved cam surfaces 265A and 266A on the cams 265 and 266, respectively, face radially outward from the shaft 268. One cam 265 is located in front of, and at a right angle to, the other cam 266. The front cam 265 underlies the counterweighted end 57A of the front feeler lever 59, and the rear cam 266 underlies the counterweighted end 58A of the rear feeler lever 60. The shaft 268 can be rotated between, and locked into, first and second positions by the price selector lock 40. In the first position, the front cam 265 is elevated above the rear cam 266, the front cam surface 265A faces upwardly, and the rear cam surface 266A faces laterally. In the second position as shown in FIGS. 3, 4 and 8, the rear cam 266 is elevated above the front cam 265, the rear cam surface 266A faces upwardly, and the front cam surface 265A faces laterally. When the shaft 268 is in its first position with the front cam 265 above the rear cam 266, the top of the front cam surface 265A contacts the bottom of the counterweighted end 57A of the front feeler lever 59 and prevents the counterweighted end 57A from moving downwardly about the first pin 61, but the front and rear cams 265 and 266 do not prevent the counterweighted end 58A of the rear feeler lever 60 from moving downwardly about the first pin 61. When the shaft 268 is in its second position with the rear cam 266 above the front cam 265, the top of the rear cam surface 266A contacts the bottom of the counterweighted end 58A of the rear feeler lever 60 and prevents the counterweighted end 58A from moving downwardly about the first pin 61, but neither cam prevents the counterweighted end 57A of the front feeler lever 59 from moving downwardly about the first pin 61.

Figure 20:
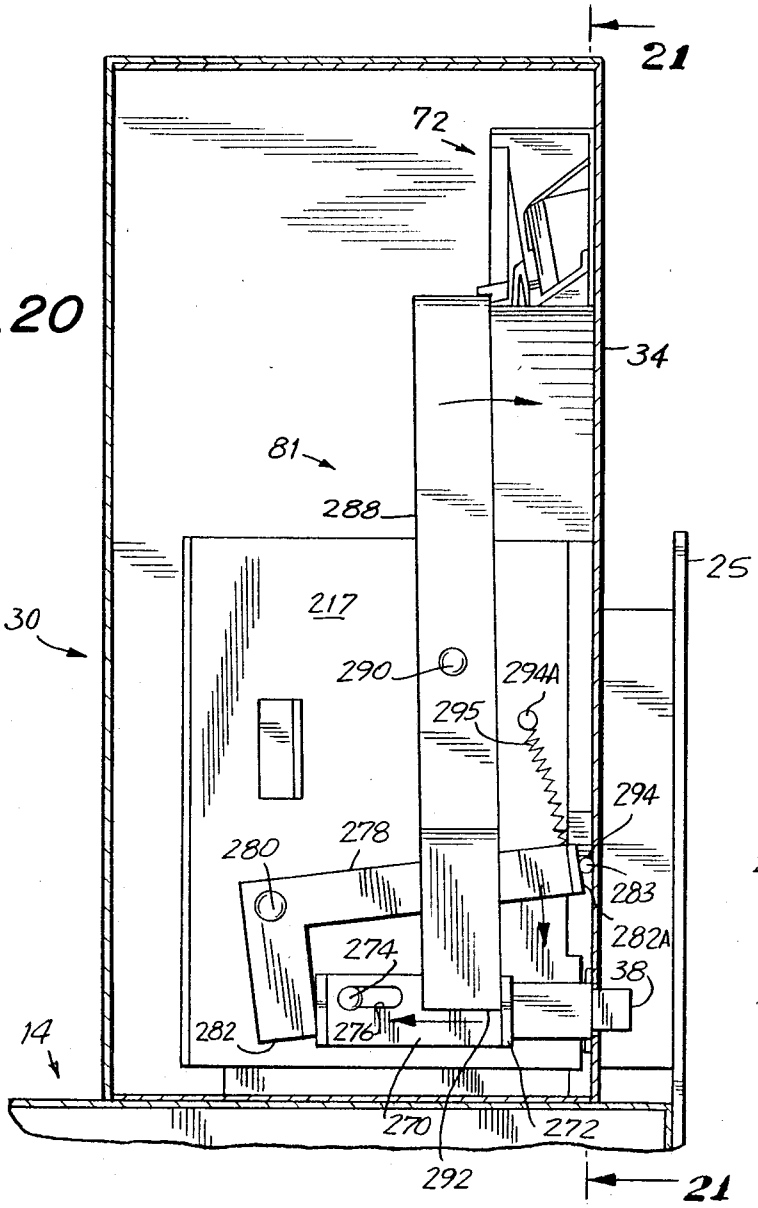
FIG. 20 is a section view of a side of the coin operated mechanism, taken along line 20—20 in FIG. 4.

Shown in FIGS. 20 and 21 is a third slider 270 extending rearwardly of the coin return actuator 38 in the front wall 34 of the upper enclosure 30. On the front of the third slider 270 is a laterally extending, square plate 272 in contact with the rear of the coin return actuator 38. The slider 270 is mounted on the side wall 217 of the escrow container 214, outside the escrow container, by means of a threaded screw 274 in the side wall 217. The screw 274 extends through a rearwardly extending slot 276 in the slider 270.

A rearwardly and downwardly extending, second lever 278 is rotatably connected to the side wall 217 of the escrow container 214, outside the escrow container, above the third slider 270. In this regard, a fourth pin 280 is mounted on the side wall 217 above the third slider 270, and the pin 280 extends laterally through the second lever 278. The rear end 282 of the second lever 278 extends downwardly from the fourth pin 280 and is located to the rear of the slider 270. The front end 282A of the second lever 278 is located in front of the pin 280 and above the slider 270. Mounted on the front end 282A of the second lever 278 is one end 283 of a laterally extending, fourth rod 284. The other end 283A of the fourth rod 284 extends laterally into a second vertical channel 286 on the front of the frame 71, adjacent the rear of the front wall 34 of the upper enclosure 30. The rear end 282 of the second lever 278 is adapted to be urged rearwardly by the rear of the third slider 270 when the coin return actuator 38 is pressed rearwardly into the upper enclosure 30 and against the front of the plate 272 on the slider 270, so that the front end 282A of the second lever 278 and the fourth rod 284 are urged downwardly.

A vertically extending, third lever 288 is rotatably connected, above the third slider 270, to the side wall 217 of the escrow container 214, outside the escrow container. In this regard, a fifth pin 290 is mounted in the side wall 217 of the escrow container 214, and the pin 290 extends laterally through the third lever 288. The bottom end 292 of the third lever 288 is located to the rear of the front plate 272 on the third slider 270 and laterally of the slider 270, and the top end 292A of the third lever 288 is located in the notch 212 of the finger 210 on the rear wall 174 of the coin sorter 72 as shown in FIG. 4. The bottom end 292 of the third lever 288 is adapted to be urged rearwardly by the front plate 272 on the third slider 270 when the coin return actuator 38 is pressed rearwardly into the upper enclosure 30 and against the front of the plate 272, so that the top end 292A of the third lever is urged frontally and the finger 210 on the rear wall 174 of the coin selector 72 is thereby urged frontally and the bottom of the rear wall 174 and the side panels 195, 195A, 197, and 197A of the dime and nickel channels 194 and 196 are urged rearwardly to open the bottom of the trough 172 and the bottom of the dime and nickel channels.

As shown in FIG. 22, the front of the upper portions of the front wall 218 of the escrow container 24, adjacent the second rod 221 on the top of the front wall 218, contact the rear of the fourth rod 284 when the rod 284 is in its uppermost position. The front wall 218 is so shaped that, when the bottom of the front wall 218 abuts against the top of the divider panel 224, the upper portions of the front wall are vertical and the lower portions of the front wall 218 extend downwardly and rearwardly to the top of the divider panel 224. As a result, the fourth rod 284, when in its uppermost position, urges the front wall 218 rearwardly, so that the bottom of the front wall 218 abuts, and is held, against the top of the divider panel 224. When the fourth rod 284 is not in its uppermost position, the shape of the front wall 218 prevents the front wall from simultaneously contacting both the fourth rod 284 and the divider 224, and hence, the fourth rod 284 cannot urge the bottom of the front wall 218 to abut against the top of the divider panel 224. As a result, the bottom of the front wall 218 hangs beneath the second rod 221, away from the divider panel 224, when the fourth rod 284 is not in its uppermost position.

As shown in FIG. 20, the bottom end 294 of a fourth vertically aligned spring 295 is connected to the front end 282A of the second lever 278. The top end 294A of the fourth spring 295 is connected to the side wall 217 of the escrow container 214. The spring 295 is adapted to urge the end 283 of the fourth rod 284 to its uppermost position, so that the fourth rod 284 urges the bottom of the front wall 218 rearwardly against the top of the divider panel 224, except when the coin return actuator 38 and the third slider 270 are urged rearwardly, so as to urge downwardly the front end 282A of the second lever 278 and the end 283 of the fourth rod 284.

As shown in FIGS. 4, 8 and 21, a sixth pin 296 is mounted on the projection 260 on the bottom of the first slider 141. The sixth pin 296 extends frontally from the projection 260, through a vertical slot 297 in the frame 71, to the front of, and beneath, the fourth rod 284. The top of the slot 297 is located just below the fourth rod 284 when the fourth rod is in its uppermost position as shown in FIG. 21. The sixth pin 296 is adapted to be moved downwardly by downward movement of the fourth rod 284, so as to cause the projection 260 and the first slider 141 to move downwardly with the sixth pin.

The operation of the coin operated mechanism 32 of this invention in the vending machine 10 is as follows.

Alternative prices are preset for newspapers or the like in the vending machine 10 by pulling the circular cams 66 and 68 rearwardly of the price wheel 148 and its gear teeth 154 and simultaneously rotating the cams 66 and 68 about the price wheel hub 146 until their notches 69 and 70 are at different angles about the hub 146 and the central rod 96 from each other, from the notch 155 in the price wheel 148 and from the higher gear tooth 126A on the ratchet wheel 124. Such different angles of the notches 69 and 70 correspond to different prices for the newspapers or the like in the vending machine 10 (e.g., the front notch 69 is preset at a higher price than the rear notch 70 in FIGS. 4 and 8). Each time a newspaper is vended or the coin return actuator 38 is utilized, the elements of the coin operated mechanism 32 are returned, in a manner which will be described below, to their original preset positions, including the notches 69, 70 and 155 and the higher gear tooth 126A which return to their different preset angles about the central rod 96.

The price selector lock 40 is then used to rotate shaft 268 to one of two positions where one of its cams (e.g., rear cam 266 in FIGS. 3, 4 and 8) is above the other to: (1) prevent the counterweighted end of the one feeler lever (e.g., end 58A of rear feeler lever 60 in FIGS. 3, 4 and 8), above the one upper cam, from moving downwardly when its finger (e.g., finger 64 in FIGS. 3, 4 and 8) can move vertically upward into the notch in the circular cam, above it (e.g., notch 70 in rear cam 68 in FIGS. 3, 4 and 8); but (2) allow the counterweighted end of the other feeler lever (e.g., end 57A of front feeler lever 59 in FIGS. 3, 4 and 8), above the other lower cam (e.g., front cam 265 in FIGS. 3, 4 and 8), to move downwardly when its finger (e.g., finger 63 in FIGS. 3, 4 and 8) can move vertically upward into the notch in the circular cam, above it (e.g., notch 69 in front cam 66 in FIGS. 3, 4 and 8).

The vending machine 10 can then be used for selling newspapers or the like to customers. In one such transaction, the customer deposits the appropriate exact change in the coin insert slot 36. Each coin falls through slot 204 in the coin sorter 72 and lands with its edge on the base 182 and with one face contacting the rear wall 174 of the trough 172. In succession, each coin then rolls downwardly and laterally on the base 188 past the partition 207 toward the chute assembly 73. A dime falls rearwardly through the second slot 190 in the rear wall 174 and rolls through the dime channel 194, beneath the penny stop 199, and into the dime chute 76. A nickel falls rearwardly through the third slot 192 in the rear wall 174 and rolls through the nickel channel 196, beneath the slug stop 200 and into the nickel chute 74. A quarter rolls past the slots 188, 190 and 192 in the rear wall 174 and past the baffle 208 and into the quarter channel 202 and falls into the quarter chute 78. Any coin smaller than a dime falls through the first slot 188 in the rear wall 174 and into the escrow container 214. Any coin or other object which becomes jammed in the coin sorter 72 (e.g., a coin or slug in the dime channel 194 which is larger than a dime and which contacts the penny stop 199) is removed from the coin sorter 72 by pressing the coin return actuator 38 to urge the third slider 270 to move rearwardly, so that the bottom end 292 of the third lever 288 is urged rearwardly, thereby urging the top end 292A of the third lever frontally, so as to urge the notched finger 210 on the rear wall 174 of the coin sorter 72 frontally, so that the bottom of the rear wall and the side panels of the dime and nickel channels 194 and 196 of the coin sorter are moved rearwardly away from the bottom panel 198, whereby the coin or object falls into the escrow container 214 and from there falls on to the ledge 226 in a manner which will be described below.

Each coin, falling through one of the coin chutes 74, 76 or 78 in succession, urges the end 83 of the trip wire 82 downwardly a measured distance from the top of the slot 170 to the end of the intersection between the slot 170 and the individual chute 74, 76 or 78. Each measured downward deflection of the end 83 of the trip wire 82 causes the counterweighted end 107A of the lever 104 and the beveled end 110A of the lower dog 109 to move upwardly and to revolve a measured angle about the central rod 96. After each such measured downward deflection, the end 83 of the trip wire 82 and the beveled end 110A of the lower dog 109 return to their original position, relative to the central rod 96, as the counterweighted end 107A of the lever 104 returns to its original position atop stop 123. Each measured angle of revolution of the beveled end 110A of the lower dog 109 about the central rod 96, resulting from the downward deflection of the end 83 of the trip wire 82, causes a measured rotation of the ratchet wheel 124 about the central rod 96. For example, each nickel rotates the ratchet wheel 124 by one gear tooth about the central rod 96, each dime rotates the ratchet wheel by two gear teeth about the central rod, and each quarter rotates the ratchet wheel by five gear teeth about the rod. The measured rotation of the ratchet wheel 124 causes corresponding measured rotation of the price wheel 148 and the circular cams 66 and 68 about the central rod 96. The sum of the measured downward deflections of the end 83 of the trip wire 82 by the deposited coins falling down the chutes 74, 76 and 78, in succession, causes the beveled end 110A and the lower dog 109 to revolve about the central rod 96 by a corresponding sum of measured angles and causes the ratchet wheel 124 and the price wheel 148 and the circular cams 66 and 68 to rotate about the central rod 96 by a corresponding sum of measured angles.

When the sum of the angular displacements of the circular cams 66 and 68 brings their notches 69 and 70 to a position where one of the notches (e.g., notch 69 on front cam 66 in FIG. 8) is directly above one of the fingers on one of the feeler levers (e.g., finger 63 on front feeler lever 59 in FIG. 8), the finger moves upwardly into the notch, provided the counterweighted end 57A or 58A of the one feeler lever 59 or 60 does not rest upon the one elevated cam surface 265A or 266A, selected by the price selector lock 40 to be above the other cam surface. Such upward movement of the one finger (e.g., finger 63 on front feeler lever 59 in FIG. 8) results in the one end 57 or 58 of the one feeler lever (e.g., end 57 of front feeler lever 59 in FIG. 8) urging one arm (e.g., front arm 54 in FIG. 8) of the T-bar 52 upwardly, so that the latch 46 is moved vertically out of the opening 50 in the tongue 48 on the rear of the extension 25 of the door 20, thereby allowing the door 20 of the vending machine 10 to be opened by the customer for access to the stack of newspapers 19 in the lower enclosure 14.

The second slider 238 on the side wall 216 of the escrow container 214 can then be moved frontally by the spring 248, so that the front edge of the horizontal member 246 of the slider 238 follows the rear edge of the tongue 48 as the tongue moves frontally out of the upper enclosure through the locking opening 44 in the front wall 34 as the extension 25 on the door 20 is moved frontally away from the front wall 34 of the upper enclosure as the door 20 is opened. Such frontal movement of the second slider 238: (1) releases the tension in spring 235 and thereby allows the finger 230 on the rear wall 220 of the escrow container 214 to move frontally, so that the rear wall 220 rotates about the third rod 222, whereby the bottom of the rear wall 220 moves rearwardly away from the top of the divider panel 224, so as to allow any money in the escrow container to fall downwardly into the coin box 228; and (2) urges the top 250A of the lever 252 to move frontally, so that the front of the projection 254 on the lever 252 and the bottom end 256 of the first vertically aligned spring 258 move downwardly, thereby causing the first spring 258 to urge the first slider 141 and the bottom end 261 of the second vertically aligned spring 262 to move downwardly. Downward movement of the first slider 141 causes its laterally extending fingers 143 and 144 to urge downwardly the second fingers 122 and 139 on the lower and upper dogs 109 and 135, so that the ratchet wheel 124 is no longer held by the beveled ends 110A and 136A of the dogs 109 and 135 and the torsion spring 130 can urge the ratchet wheel 124, together with the price wheel 148 and the circular cams 66 and 68, to rotate counterclockwise (when viewed as in FIG. 6) to their original positions: (1) where the higher gear tooth 126A abuts against the first tab 128 on the rear plate 86; and (2) notches 69 and 70 on the circular cams 66 and 68 and the notch 155 on the price wheel 148 are in their original positions about the central rod 96. The downward movement of the first slider 141 also causes the third vertically aligned spring 264 to urge the one end 57 and 58 of each feeler lever 59 and 60 downwardly, so that any finger 63 or 64 of the feeler levers in a notch 69 or 70 in a circular cam 66 or 68 is moved downwardly out of the notch, whereby: (1) both circular cams 66 and 68 are then free to rotate counterclockwise (when viewed as in FIG. 4) with the price wheel 148 and the ratchet wheel 124; and (2) the T-shaped bar 52 and its arms 54 and 56 can move downwardly with the one end 57 and 58 of each feeler lever 59 and 60, so that the latch 46 can move downwardly past the top of the locking opening 44 in the front wall 34 of the upper enclosure 30.

When the door 20 of the lower enclosure 14 is reclosed so that the tongue 48 on the door extension 25 is inserted in the locking opening 44, the rear edge of the rearwardly moving tongue initially urges the front beveled edge of the latch 46 to move upwardly. Then, the latch falls downwardly into the opening 50 in the tongue 48. As the tongue 48 moves rearwardly, the rear edge of the tongue 48 also urges the front edge of the horizontal member 246 of the second slider 238 to move rearwardly. As the second slider 238 moves rearwardly, the second vertically aligned spring 262 urges the first slider 141 and the top end 256A of the first vertically aligned spring 258 to move upwardly, thereby causing the first spring 258 to urge the front of the projection 254 on the lever 252 to move upwardly, so that the top 250A of the lever 252 moves rearwardly against the second slider 238. As the second slider 238 moves rearwardly, it also urges rearwardly the rear end 234A of the spring 235, so that the finger 230 on the rear wall 220 of the escrow container 214 is urged rearwardly, whereby the bottom of the rear wall 220 is moved frontally against the divider panel 224 to close the escrow container.

If the customer urges the coin return actuator 38 rearwardly into the upper enclosure 30 before the customer has opened the door 20 of the vending machine and the coins in the escrow container 214 have fallen into the coin box 228, the third slider 270 will be urged rearwardly against the rear end 282 of the second lever 278, so that its front end 282A will be urged downwardly. This will cause the fourth rod 284 to move downwardly away from the upper portions of the front wall 218 of the escrow container 214, so that the bottom of the front wall 218 moves away from the divider panel 224, thereby allowing any coins in the escrow container 214 to fall downwardly onto the ledge 226 where the coins can be reclaimed through the coin return opening 42 in the front wall 34 of the upper enclosure 30. Such downward movement of the fourth rod 284 also will move the sixth pin 296 downwardly, thereby moving the first slider 141 and its fingers 143 and 144 downwardly, so as to release the ratchet wheel 124 from the lower and upper dogs 109 and 135 and allow the ratchet wheel, the price wheel 148 and the circular cams 66 and 68 to rotate to their original positions as described above.

It is thought that the invention and many of its attendant advantages will be understood from the foregoing description, and it will be apparent that various changes can be made in the vending machine 10, its coin operated mechanism 32 and in their method of operation without departing from the spirit and scope of the invention herein or sacrificing all of its material advantages, the devices and methods hereinbefore described being merely preferred embodiments. In this regard, the terms herein, such as "front", "rear", "horizontal", "vertical", "lateral", "up", "down", "bottom" and "top", are relative terms which describe the spatial relationships of the elements of the vending machine 10 and its coin operated mechanism 32 as shown in FIGS. 1 to 22. Such terms are not to be construed as limiting the invention in the vending machine and coin operated mechanism.

We claim:

1. In a vending machine having a coin operated mechanism which includes:

(a) a coin sorter for separating coins, deposited in the machine, into different denominations;

(b) a coin chute assembly comprising at least one generally vertical chute through which coins of a denomination, from the coin sorter, fall;

(c) a trip wire, one end of which extends through the chute in the coin chute asembly and can move downwardly in the chute with downward movement of a coin through the chute along a measured distance in the chute;

(d) a totalizer, connected to the other end of the trip wire, for counting the value of coins which fall through the chute in the coin chute assembly; and (e) a vending controller connected to the totalizer; the improved totalizer which comprises:

a lever which is connected at one end to the other end of the trip wire and is rotatably connected between its ends to the mechanism; said one end of the lever moving downward about its center of rotation with downward movement of said one end of the trip wire;

a first dog, rotatably connected to the lever between an adjacent end of the lever and the center of rotation of the lever; one end of the first dog extending toward said center of rotation and being adapted to revolve about the rotatable connection of the first dog to the lever, so as to move vertically relative to the lever; and a ratchet wheel, parallel to the lever and the first dog and located on the same side of the lever as the first dog; the ratchet wheel being adapted to rotate about said center of rotation; said one end of the first dog being adapted to urge a tooth on the circumference of the ratchet wheel to revolve in one direction about said center of rotation with revolution of the first dog about said center of rotation when said one end of the lever moves downwardly with said one end of the trip wire; a tooth on the ratchet wheel that is higher than the other teeth; spring means for urging the ratchet wheel to rotate about said center of rotation in a direction opposite to said one direction; and a stop connected to the mechanism and adapted to abut against the higher tooth to stop the ratchet wheel from rotating in said opposite direction.

2. The machine of claim 1 wherein the end of the lever, adjacent to the first dog, is the other end of the lever, remote from said one end of the lever.

3. The machine of claim 2 wherein said one end of the first dog is beveled downwardly from the top thereof and is adapted to fall downwardly between adjacent gear teeth of the ratchet wheel.

4. The machine of claim 3 wherein a finger is provided on the side of the first dog adjacent to the lever; the finger extends toward and above the lever; and spring means are provided on top of the lever for restricting upward movement of the finger away from the top of the lever and upward movement of said one end of the first dog away from the ratchet wheel by rotation of the first dog about the rotatable connection of the first dog to the lever.

5. The machine of claim 3 wherein a second dog is rotatably connected to the mechanism on the same side of the rotatable connection of the lever to the mechanism as the first dog; one end of the second dog extends toward the rotatable connection of the lever to the mechanism; and said one end of the second dog is adapted to revolve about its rotatable connection to the mechanism, so that it can move vertically away from the ratchet wheel or vertically toward the ratchet wheel, so as to abut against a gear tooth on the circumference of the ratchet wheel to prevent the ratchet wheel from rotating in said opposite direction.

6. The machine of claim 5 wherein the second dog is rotatably connected to the mechanism above the rotatable connection of the lever to the mechanism and said one end of the second dog is beveled downwardly towards the ratchet wheel and is adapted to fall downwardly between adjacent gear teeth of the ratchet wheel.

7. The machine of claim 6 wherein a plurality of adjacent gear teeth on the circumference of the ratchet wheel extend only part way toward the lever from the side of the ratchet wheel remote from the lever; said one end of the first dog is adapted to contact only the portions of gear teeth on the ratchet wheel closer to the lever than said plurality of gear teeth; and said one end of the second dog is adapted to contact a portion of each of the gear teeth on the ratchet wheel.

8. The machine of claim 6 wherein the other end of each dog extends away from the rotatable connection of the lever to the mechanism and is adapted to be urged downwardly, so that each dog pivots about its rotatable connection and said one beveled end of each dog moves upwardly out from between adjacent gear teeth of the ratchet wheel.

9. The machine of claim 1 wherein an end of the lever is counterweighted, so that said one end of the lever can move upwardly after moving downwardly with said one end of the trip wire.

10. The machine of claim 9 wherein a stop is mounted on the mechanism for restricting upward movement of said one end of the lever.

11. The machine of claim 1 that includes an improved vending controller which comprises:

a circular cam, parallel to the lever and connected to the ratchet wheel; the circular cam being adapted to rotate about its center with rotation of the ratchet wheel; the circular cam having means on its circumference for indicating when the total value of coins, deposited in the machine and counted by the totalizer, at least equals the price of an item being vended; the indicating means being adapted to being disengaged temporarily from revolving with rotation of the ratchet wheel, so that the indicating means can be revolved about the center of the circular cam and relative to the position of the higher gear tooth about the rotatable connection of the lever to the mechanism to change the price of the item being vended.

12. The machine of claim 11 wherein the indicating means comprises a notch in the circumference of the circular cam.

13. The machine of claim 12 wherein the improved vending controller also comprises:

a feeler lever rotatably connected to the mechanism; one end of the feeler lever being urged radially toward the center of the circular cam; said one end of the feeler lever having a finger which extends from the feeler lever towards the center of the circular cam, which is urged against the circumference of the circular cam, and which is urged into the notch in the circular cam when the notch, the finger and the center of the circular cam are aligned.

14. The machine of claim 13 wherein a plurality of parallel feeler levers and a plurality of parallel, concentric, circular cams are provided; a plurality of cams are provided extending radially outward from a common shaft adjacent an end of each feeler lever; and each cam is vertically aligned with the end of a different feeler lever and can be moved vertically adjacent the vertically aligned end of its feeler lever by rotating the shaft, so that vertical movement of the end of one feeler lever towards its cam is prevented by its cam but vertical movement of the end of another feeler lever towards its cam is not prevented by its cam.

15. The machine of claim 13 wherein the feeler lever is below the circular cam, the other end of the feeler lever is counterweighted, and the finger is on top of said one end of the feeler lever, so that the top of the finger is urged to move upwardly against the circumference of the circular cam and into the notch of the circular cam.

16. The machine of claim 13 wherein one end of a bar is connected to a latch for an access door of the machine; the latch being movable by the bar from a first position where the latch holds the access door closed to a second position where the latch does not hold the access door closed; and the other end of the bar is adapted to move with said one end of the feeler lever when the finger on the feeler lever moves into the notch of the circular cam, so that the other end of the bar is moved toward the circular cam and, thereby, the latch is moved from its first position to its second position.

17. The machine of claim 16 wherein the feeler lever is below circular cam, the other end of the feeler lever is counterweighted, and the finger is on top of said one end of the feeler lever, so that the top of the finger is urged to move upwardly against the circumference of the circular cam and into the notch of the circular cam; and the bar extends upwardly from the latch with its other end on top of said one end of the feeler lever, so that the bar and latch move upwardly with the finger when the finger moves upwardly into the notch of the circular cam to move the latch from its first position to its second position.

18. The machine of claim 16 wherein the improved totalize comprises means for disengaging said one end of the first dog from the gear teeth of the ratchet wheel when the finger on the feeler lever moves into the notch of the circular cam.

19. The machine of claim 18 wherein the disengaging means comprises means for urging said one end of the first dog to revolve about its rotatable connection to the lever and thereby move vertically away from the ratchet wheel.

* * * * *